US005620107A

United States Patent [19]

Takeuchi

[11] Patent Number: 5,620,107

[45] **Date of Patent: *Apr. 15, 1997**

[54] CAP WITH A HINGED TOP LID

[75] Inventor: Kiyoshi Takeuchi, Funabashi, Japan

[73] Assignee: Kao Corporation, Tokyo, Japan

[ * ] Notice: The term of this patent shall not extend beyond the expiration date of Pat. No. 5,501,348.

[21] Appl. No.: 562,101

[22] Filed: Nov. 22, 1995

Related U.S. Application Data

[63] Continuation of Ser. No. 260,270, Jun. 14, 1994, Pat. No. 5,501,348.

[30] Foreign Application Priority Data

Jun. 16, 1993 [JP] Japan ..... 5-168356
Mar. 28, 1994 [JP] Japan ..... 6-79307

[51] Int. Cl.[6] ..... B65D 43/24

[52] U.S. Cl. ..... 215/235; 220/335; 220/339

[58] Field of Search ..... 215/235, 237; 220/264, 334, 335, 339, 342, 344; 222/517, 546, 556; 132/293, 294, 295, 315

[56] References Cited

U.S. PATENT DOCUMENTS 5,344,037 9/1994 Favre ..... 220/264

FOREIGN PATENT DOCUMENTS 385879 9/1990 European Pat. Off. ..... 220/335

*Primary Examiner*—Allan N. Shoap
*Assistant Examiner*—Nathan Newhouse
*Attorney, Agent, or Firm*—Oblon, Spivak, McClelland, Maier & Neustadt, P.C.

[57] ABSTRACT

A cap comprises a cap body and a top lid, which are united by a hinge. A rubber-like elastic member is provided on the cap body such as to be elastically deformed between the cap body and the top when the top lid is closed.

3 Claims, 22 Drawing Sheets

CAP WITH A HINGED TOP LID

This is a continuation of U.S. patent application Ser. No. 08/260,270 filed on Jun. 14, 1994 now U.S. Pat. No. 5,501,348.

BACKGROUND OF THE INVENTION

1. Field of the invention

The present invention relates to a cap with improved opening and closing functions of a top lid relative to a cap body.

2. Discussion of the Related Art

A cap in the related art comprises a cap body fitted on an open portion of a container and a top lid to be opened and closed relative to the cap body. Further, in a cap which is disclosed in Japanese Utility Model Laid-Open Publication No. 3-69656 and also in Japanese Utility Model Laid-Open Publication No. 63-88965, a leaf spring provided between a cap body and a top lid provides a biasing force to open the top lid.

However, the leaf spring has a drawback in that it provides a strong biasing force to quickly open the top lid. In addition, the leaf spring is generally made of a metal and is readily rusted. Therefore, rust may be introduced into the content in the container when the content is brought out of the container through a nozzle in the cap body.

SUMMARY OF THE INVENTION

The present invention has been developed to overcome the abovementioned drawbacks. Accordingly, an object of the present invention is to provide for a novel cap, which has no possibility of intrusion of rust in the container content and permits its top lid to be opened gently at an adequate speed by the restoring force of a rubber-like elastic member.

According to the present invention, there is provided a cap comprising a cap body with a top lid hinged thereto by a hinge such that the top lid is closed by a lock mechanism formed on the cap body and on the top lid. The cap further comprises a rubber-like elastic member with a first end and a second end. The first end of the rubber-like elastic member is secured near the hinge of the top lid and the second end of the rubber-like elastic member is capable of compressive deformations and bending elastically when pushed by a restraining wall of the cap body between the cap body and the top lid when the top lid is closed.

Also, according to the invention at least either one of the surfaces of the cap body and the rubber-like elastic member that are spaced apart when the top lid is opened and are in contact with each other when the top lid is closed is a non-flat surface.

Thus, with the cap according to the invention, in which the rubber-like elastic member provided between the cap body and the top lid is elastically deformed when the top lid is closed, with the release of the lock mechanism, the top lid is opened by the restoring force of the rubber-like elastic member that has been elastically deformed. The restoring force is not excessive unlike that of a leaf spring or the like, and thus the top lid can be opened gently at an adequate speed.

Further, what acts as the restoring force to the top lid is the rubber-like elastic member and not a leaf spring or like member made of a metal, it is therefore not subjected to being rusted, and thus there is no possibility of intrusion of rust in the content that is brought out from a cap body nozzle.

In a further aspect, with the cap according to the invention, leaving the top lid closed for a long time (particularly at a high temperature) results in the breeding-out of such additives as a lubricant and an anti-charging agent that are contained in the resin material of the cap body or in the rubber-like elastic member, which may cause the blocking of the contact surfaces of the cap body and the rubber-like elastic member. Therefore, when it is intended to open the top lid that has been left closed for long time, the top lid may not be opened to a sufficient extent due to the blocking noted above. According to the invention, at least either one of the surfaces of the cap body and the rubber-like elastic member that are spaced apart when the top is opened and are in contact with each other when the top lid is closed is a non-flat surface, and thus it is possible to prevent the blocking. That is, with the cap provided with the blocking prevention means noted above according to the invention, the top lid having been left closed for a long time can be reliably opened to a great extent by the restoring force of the rubber-like elastic member.

BRIEF DESCRIPTION OF THE DRAWINGS

A more complete appreciation of the invention and many of the attendant advantages thereof will readily obtained as the same becomes better understood by reference to the following detailed description when considered in connection with the accompanying drawings, wherein.

DETAILED DESCRIPTION OF THE PREFERRED EMBODIMENTS

Now, embodiments of the invention will be described with reference to the drawings.

FIRST EMBODIMENT

Figure 1A:
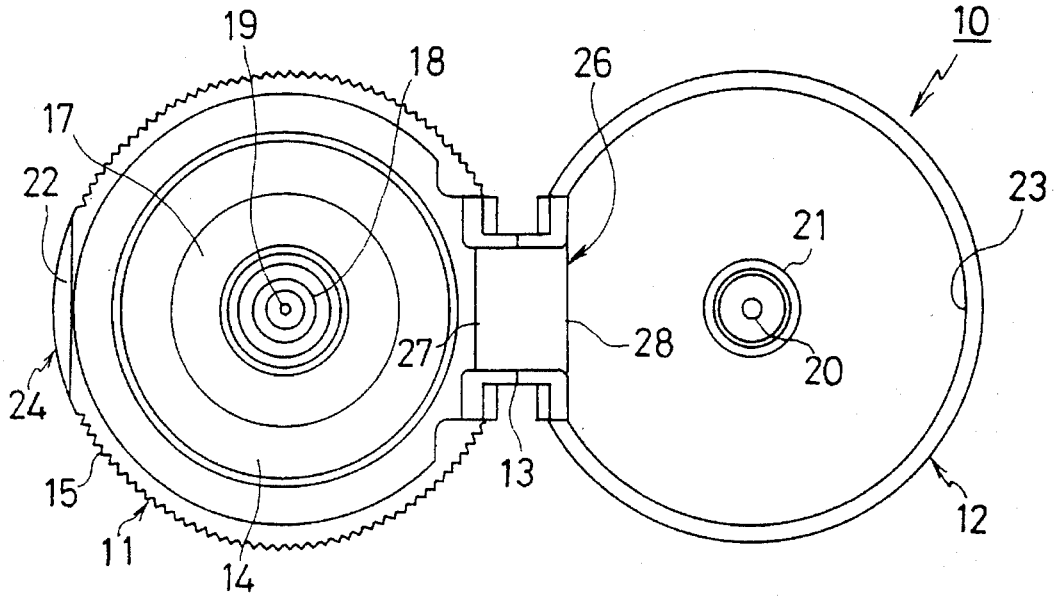
FIGS. 1A and 1B show a first embodiment of the cap according to the invention with a top lid in an open state, FIG. 1A being a plan view, FIG. 1B being a sectional view.
Figure 1B:
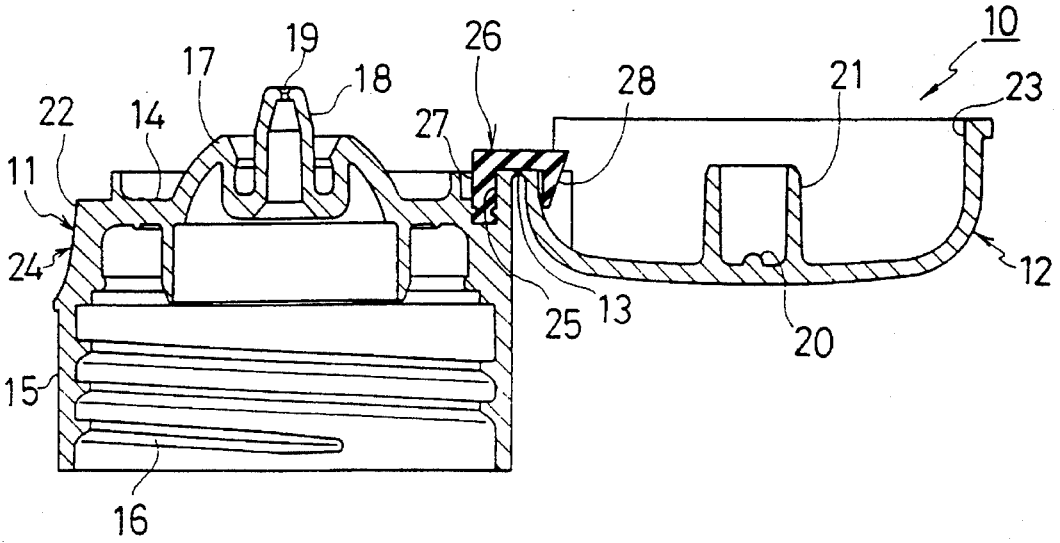
Figure 2:
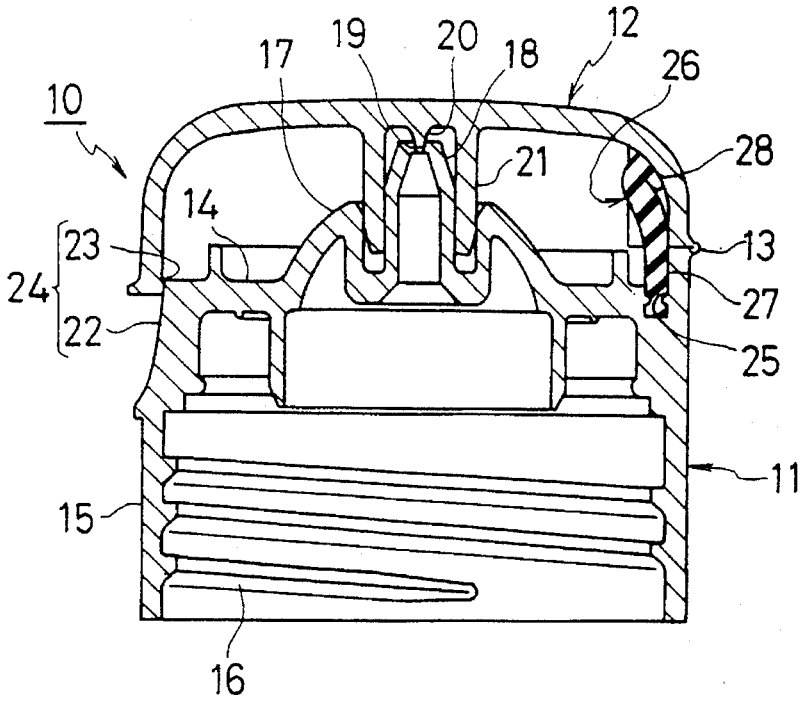
FIG. 2 is a sectional view showing the cap in FIGS. 1A and 1B with the top lid in a closed state.

FIGS. 1A, 1B and 2 show the first embodiment of the cap 10, which comprises a cap body 11 with a top lid 12 hinged thereto by a main hinge 13.

The cap body 11 has a substantially cylindrical shape with a top wall 14. Its cylindrical portion 15 has an inner female thread 16. A container (not shown) has a male thread formed adjacent its opening, and the cap 10 is mounted on the container with the female thread 16 screwed on the male thread. The top wall 14 has a central ting-like raised portion 17 and also has a nozzle 18 formed centrally thereof. The nozzle 18 has a nozzle opening 19. By squeezing the container, the content in the container can be discharged (brought out) through the nozzle opening 19.

The top lid 12 is substantially cup-shaped and has an integral inner seal 20 and also an integral outer seal 21 surrounding the inner seal 20. When the top lid 12 is closed, the inner seal 20 can be fitted liquid-tight in the nozzle opening 19. At the same time, the outer seal 21, which is cylindrical in shape, is fitted liquid-tight between the ring-like raised portion 17 and the nozzle 18. Thus, the nozzle opening 19 can be reliably scaled by the inner and outer seals 20 and 21.

The main hinge 13 is formed between the cap body 11 and the top lid 12 and has a small thickness. The fulcrum portion of the main hinge 13 is only capable of a flexing deformation. The fulcrum portion is found at a fixed position. The cap body 11, the top lid 12 and the main hinge 13 are formed as a one-piece molding. The cap body 11 has a lock surface 22 formed on its side opposite the main hinge 13. When the top lid 11 is closed, a lock portion 23 of the top lid 12 can engage with the lock surface 22. The lock surface 22 and the lock portion 23 constitute a lock mechanism 24. The outer seal 21 also serves as a lock mechanism as it is fitted between the ring-like raised portion 17 and the nozzle 18.

Figure 3:
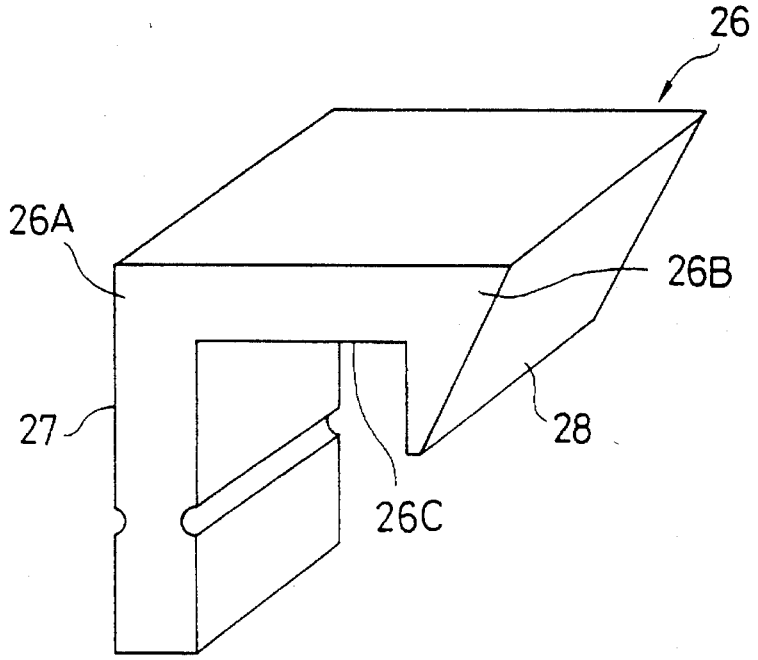
FIG. 3 is a perspective view showing a rubber-like elastic member in the cap in FIGS. 1A and 1B.

The top wall 14 of the cap body 11 has a groove 25 formed near the main hinge 13. A rubber-like elastic member 26 is fitted in the groove 25. The rubber-like elastic member 26 is made of rubber or elastomer (for instance methylvinyl type raw rubber synthesized from "KE951U" (a trade name by Shinetsu Kagaku Kogyo Co., Ltd.) as compound and "C-8" (a trade name by the same company) as vulcanizer). The elastic member 26, as shown in FIG. 3, has a channel-shaped sectional profile. It has one end 27 fitted in the groove 25, and its other end 28 has a wedge-like tapered shape, the tip of which is capable of compressive and bending deformations in contact with the inner surface of the top lid 12.

Figure 4C:
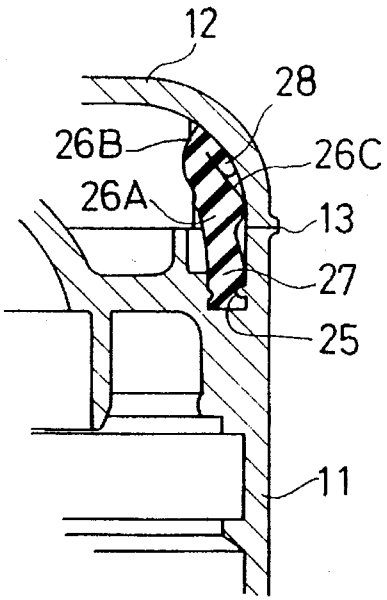
FIGS. 4A, 4B and 4C are fragmentary sectional views illustrating the function of the cap in FIGS. 1A and 1B.
Figure 4B:
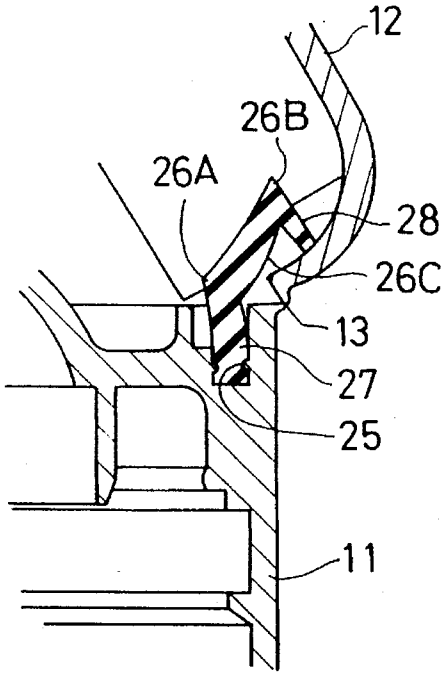
Figure 4A:
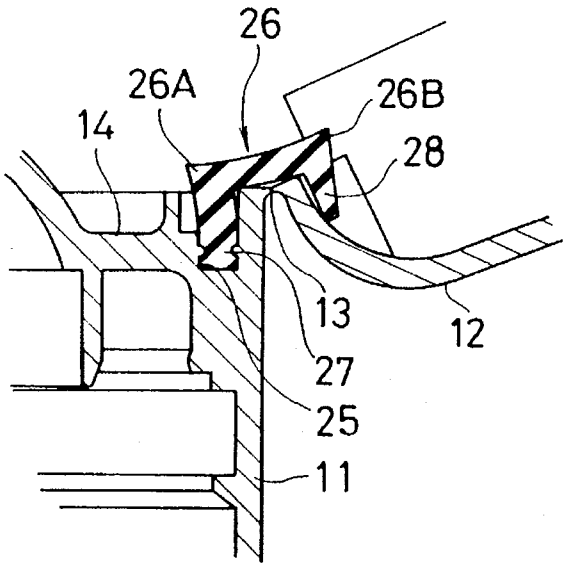

More specifically, as shown in FIGS. 4A and 4B, during the closing operation of the top lid 12, the tip of the other end portion 28 of the rubber-like elastic member 26 is brought into contact and pushed by the inner surface of the top lid 12. As it is pushed, the other end portion 28 of the rubber-like elastic member 26 is bent inward, and portions 26A and 26B of the rubber-like elastic member 26 undergo elastic deformation. When the top lid 12 is closed, the other end portion 28 is brought into contact with the inner surface 26C of the rubber-like elastic member 26 and compressively deformed.

Figure 5C:
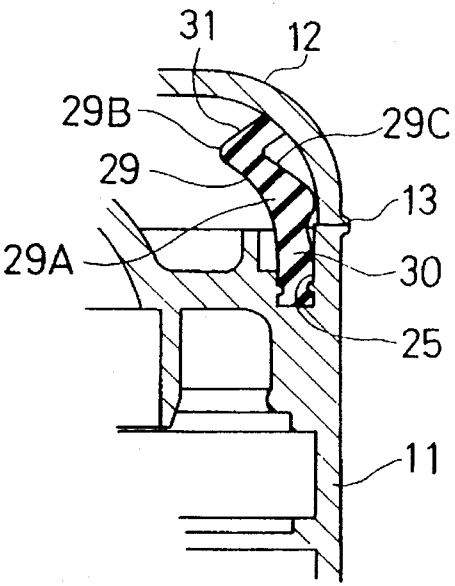
FIGS. 5A, 5B and 5C are fragmentary sectional views illustrating the function of a comparative example to make clear the operation of the cap in FIGS. 1A and 1B.
Figure 5B:
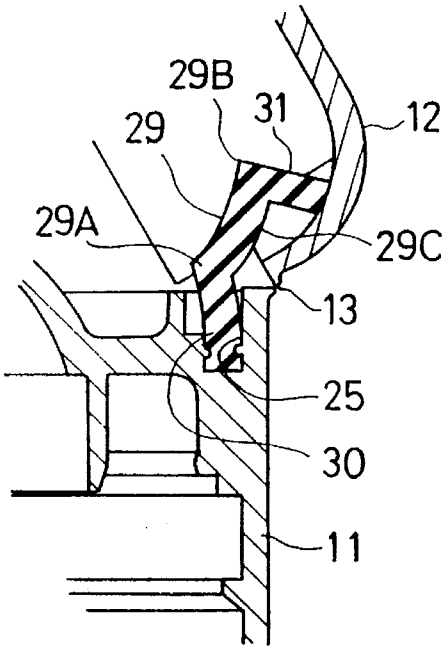
Figure 5A:
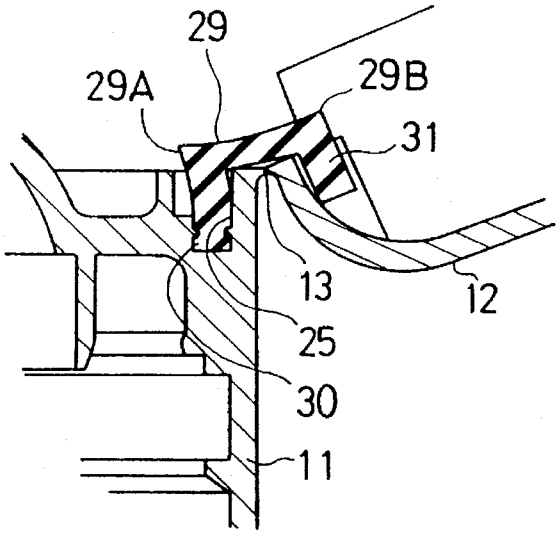

In case of a rubber-like elastic member 29 as shown in FIG. 5A, which is channel-shaped in sectional profile and has one end 30 fitted in a groove 25 in the cap body 11, and another end 31 which does not have a wedge-like tapered shape, the end 31 has a high mechanical strength. Thus, with the tip of the other end 31 pushed by the inner surface of the top lid 12 when closing the top lid 12, a portion 29A is bent, but a portion 29B does not bend under a bending deformation, as shown in FIG. 5B. Thus, when closing the top lid 12, the other end 31 is not folded between the inner surface 29C of the rubber-like elastic member 29 and the inner surface of the top lid 12 but escapes to the outside, and no compressive deformation takes place, as shown in FIG. 5C.

As shown in FIGS. 4A to 4C, the rubber-like elastic member 26 undergoes compressive and bending deformations. Thus, with the release of the lock between the lock portion 23 and lock surface 22 of the lock mechanism 24, the elastic restoring force due to the compressive and bending deformations noted above acts on the top lid 12. The top lid 12 thus can be opened gently at an adequate speed.

In addition, unlike the case of FIGS. 5A to 5C, in which bending deformation alone is caused, it is possible to obtain compressive deformation as well. This means that it is possible to generate a higher restoring force with a rubber-like elastic member having substantially the same size. In other words, it is possible to use a more compact rubber-like elastic member to obtain a desired restoring force. Further, the rubber-like elastic member 26 may be fitted by merely providing the groove 25 in the cap body 11 which is provided with the top lid 12 having the inner surface, and thus it may have a shape in a wide scope of applications.

Further, what provides the restoring force to the top lid 12 is the rubber-like elastic member 26 and not a leaf spring or the like made of a metal, it is not rusted, and thus there is no possibility of intrusion of rust in the container content that is brought out through the nozzle opening 19 of the cap body 11.

Furthermore, since the end 27 of the rubber-like elastic member 26 is fitted in the groove 25 formed in the cap body 11 without use of any adhesive or the like, there is neither the possibility of flow-out of adhesive into the content in the container, nor a possibility of a deterioration of any adhesive by the content in the container.

SECOND EMBODIMENT

In the second embodiment, parts like those in the preceding first embodiment are designated by like reference numerals and symbols and are not described again.

Figure 6A:
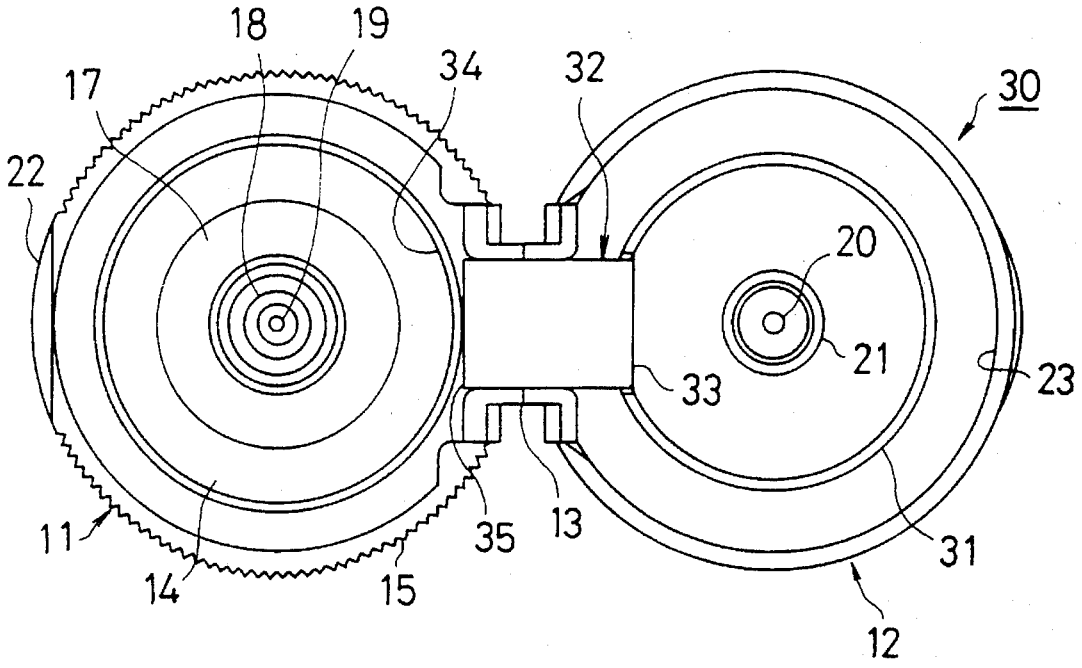
FIGS. 6A and 6B show a second embodiment of the cap according to the invention with a top lid in an open state, FIG. 6A being a plan view, FIG. 6B being a sectional view.
Figure 6B:
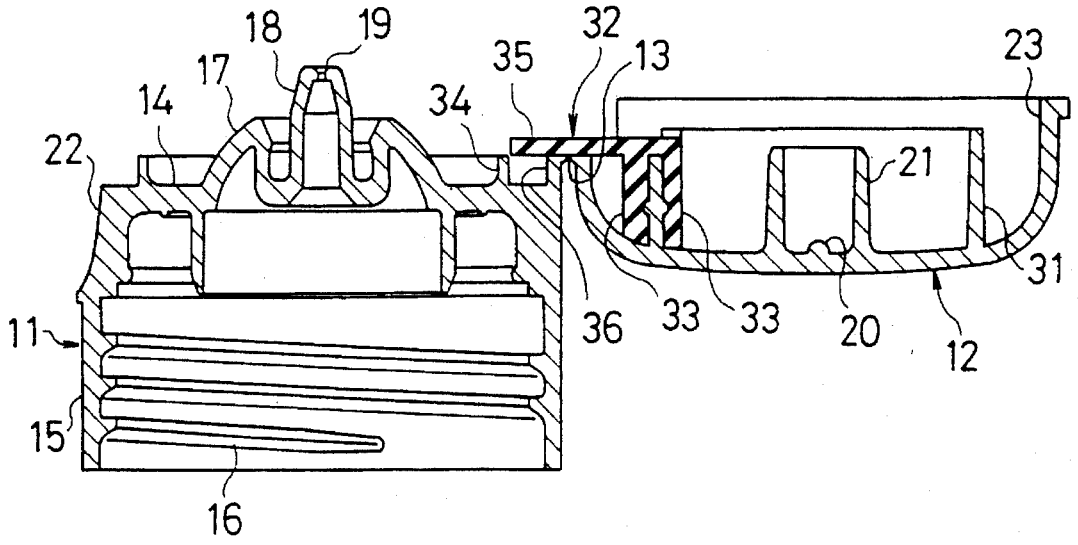
Figure 7:
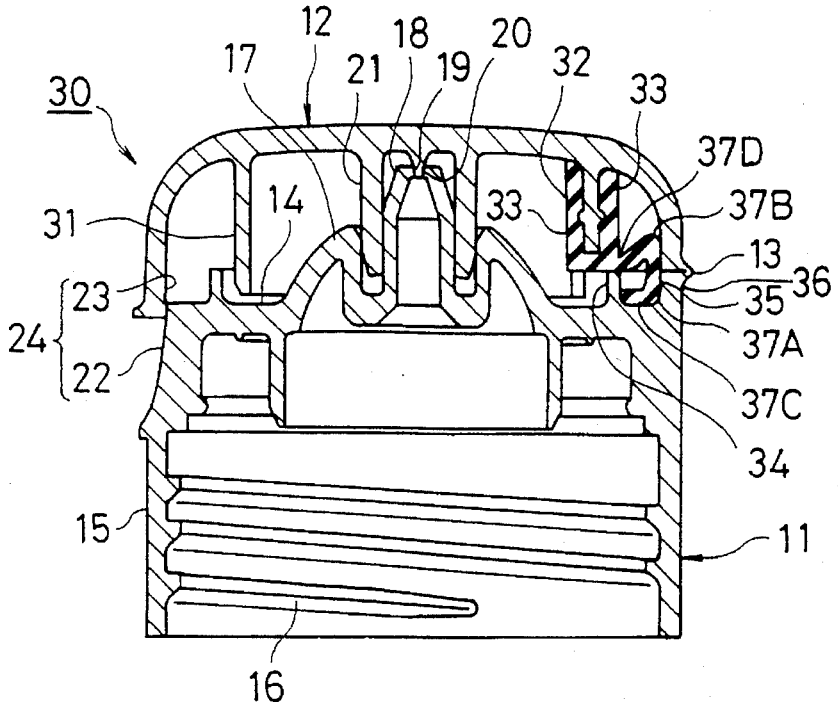
FIG. 7 is a sectional view showing the cap in FIGS. 6A and 6B with the top lid in a closed state.
Figure 8:
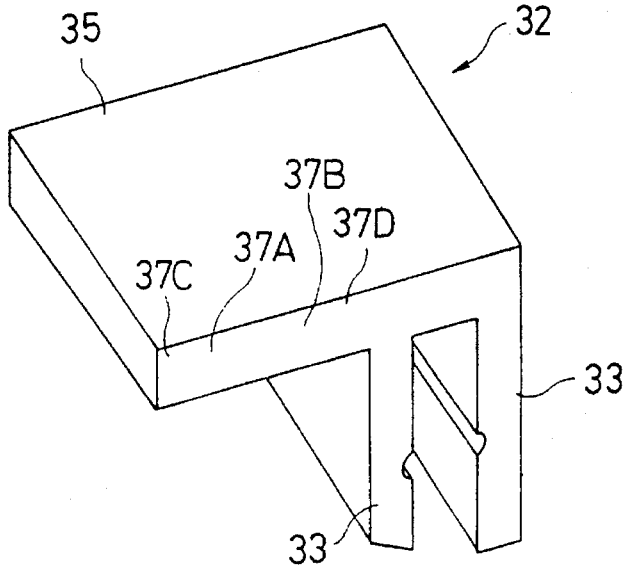
FIG. 8 is a perspective view showing a rubber-like elastic member in the cap in FIGS. 6A and 6B.

FIGS. 6A, 6B and 7 show the second embodiment of the cap 30. In this instance, the top lid 12 has a cylindrical support 31 surrounding the outer seal 11. A rubber-like elastic member 32 is secured to the cylindrical support 31. As in the previous embodiment, the rubber-like elastic member 32 is made of rubber or elastomer (for instance methylvinyl type raw rubber synthesized from "KE9951U" (a trade name by Shinetsu Kagaku Kogyo Co., Ltd.) as a compound and "C-8" (a trade name by the same company) as a vulcanizer). The rubber-like elastic member 32 has an F-shaped sectional profile (FIG. 8), and it is secured to the top lid 12 such that its two clamp portions 33 provided at one end of it clamp the cylindrical support 31. Meanwhile, the top wall 14 of the cap body 11 has a ring-like restraining wall 34 surrounding the ring-like raised portion 17. An operating portion 35 of the rubber-like elastic member 32 is located near the outer periphery of the restraining wall 34.

Thus, when closing the top lid 12, as shown in FIG. 7, the operating portion 35 of the rubber-like elastic member 32 is pressure fitted in the space between the restraining wall 34 and outer wall 36 of the cap body 11 to bring about bending deformation of portions 37A and 37B and compressive deformation of portions 37C and 37D of the rubber-like elastic member 32. By releasing the lock mechanism 24, as in the above first embodiment, the elastic restoring force due to the compressive and bending deformations noted above acts on the top lid 12 to cause the top lid 12 to be opened gently. Thus, the rubber-like elastic member 32 of the present invention undergoes compressive and bending deformations. With the release of the lock between the lock portion 23 and lock surface 22 of the lock mechanism 24, the elastic restoring force do to the compressive and bending deformations noted above acts on the top lid 12. The top lid 12 thus can be opened gently at an adequate speed.

In addition, in which bending deformation alone is caused, it is possible to obtain compressive deformations as well. This means that it is possible to generate a higher restoring force with a rubber-like elastic member having substantially the same size. In other words, it is possible to use a more compact rubber-like elastic member to obtain a desired restoring force.

Further, what provides the restoring force to the top lid 12 is the rubber-like elastic member 32 and not a leaf spring or the like made of metal, it is not rusted, and thus there is no possibility of intrusion of rust in the container content that is bought out through the nozzle opening 19 of the cap body 11.

Furthermore, since the end 33 of the rubber-like elastic member 32 is fitted in the cylindrical support 31 of the top lid 12 without use of any adhesive or the like, there is neither the possibility of flow-out of adhesive into the content in the container, nor the possibility of a deterioration of any adhesive by the contact in the container.

In the cap 10, both (or either one) of the surfaces of the cap body 11 and the rubber-like elastic member 32, which are separated from each other when the top lid 12 is opened and are brought into contact with each other when the top lid is closed, can be made to be non-flat surfaces. The non-flat surfaces are formed by embossing. Alternately, they are provided with a plurality of small protuberances. Therefore, since the surfaces of the cap body 11 and the rubber-like elastic member 32 that are brought into contact with each other when closing the top lid are made are made non-flat surfaces,.even with breeding-out of lubricant, anti-charging agent and other additives contained in the resin of the cap body 11 as a result of leaving the top lid 12 in closed state for a long time (particularly at a high temperature), there is no possibility of blocking of the contact surfaces of the cap body 11 and the rubber-like elastic member 32. The top lid 12 thus can be opened to a great extent by the elastic restoring force of the rubber-like elastic member 32 even after it has been left closed for a long time. Therefore, there is no possibility of intrusion of rust into the container content, and the top lid can be opened gently and at an adequate speed by the restoring force of the rubber-like elastic member.

THIRD EMBODIMENT

In the third embodiment, parts like those in the previous first embodiment are designated by like reference numerals and symbols and are not described again.

Figure 9A:
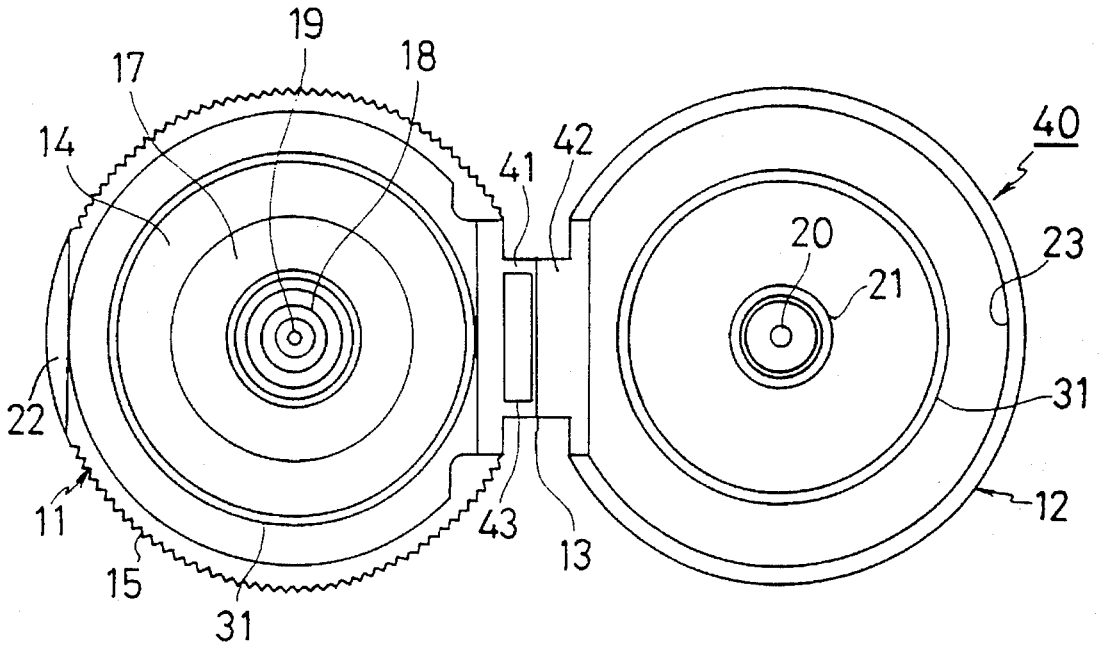
FIGS. 9A and 9B arc sectional views showing a third embodiment of the cap according to the invention with a top lid in an open state, FIG. 9A being a plan view, FIG. 9B being a sectional view.
Figure 9B:
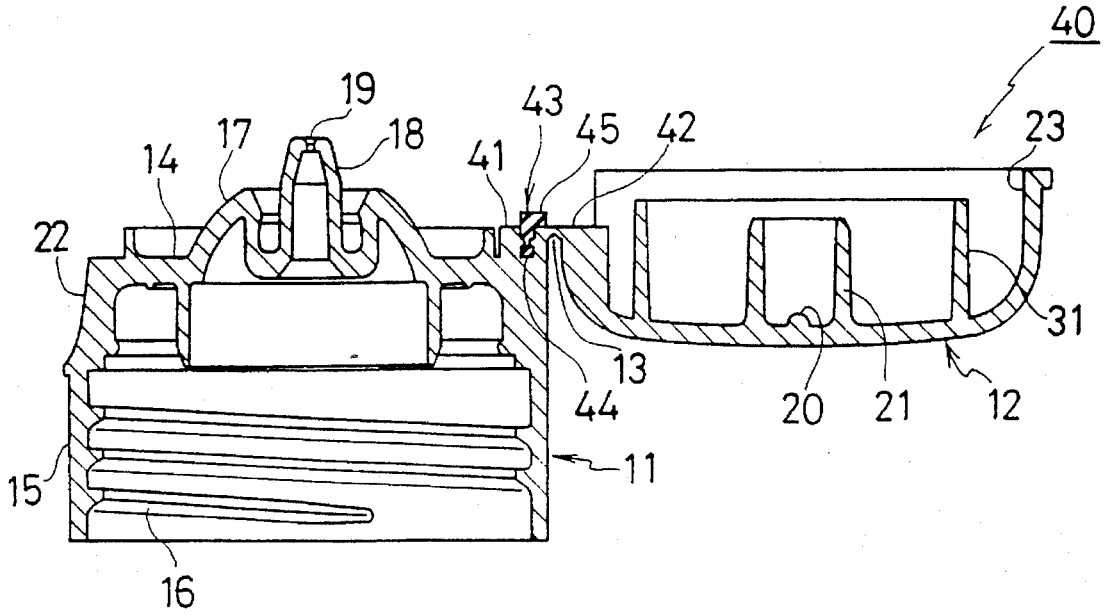

FIGS. 9A and 9B show the third embodiment of the cap 40. The cap body 11 and the top lid 12 of the cap 40 have respective flat portions 41 and 42 near the main hinge 13. A rubber-like elastic member 43 is fitted in the flat portion 41 of the cap body 11. The rubber-like elastic member 43, as shown in FIG. 10, has an I-shaped sectional profile, and it is fitted in a groove 44 formed in the flat portion 41 of the cap body 11 such that its head portion 45 projects form the groove 44.

Figure 10A:
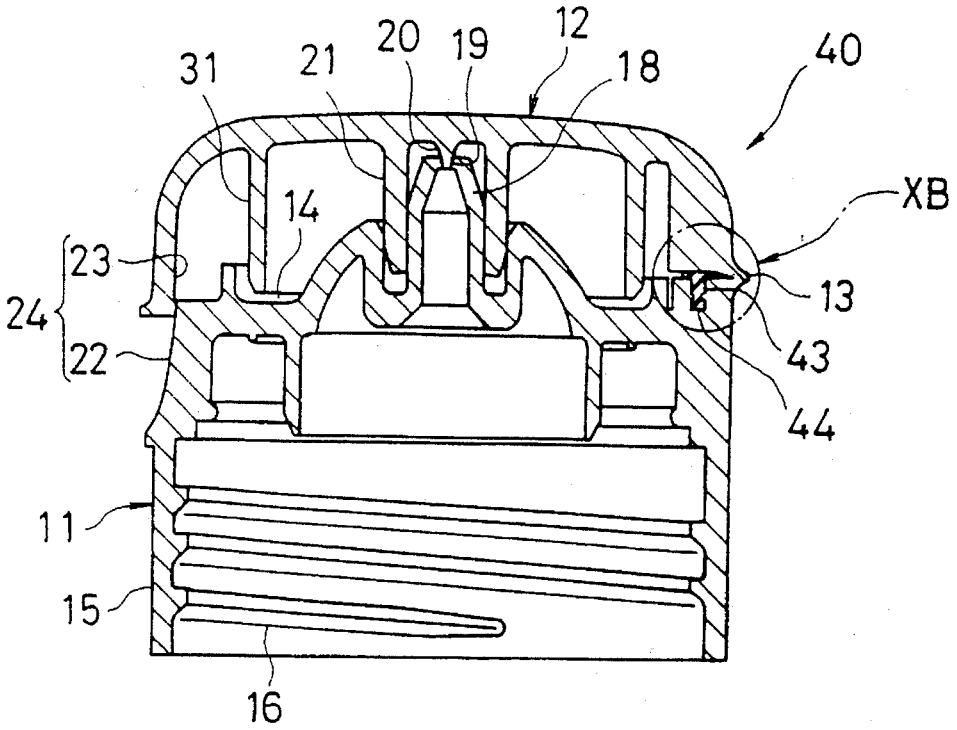
FIG. 10A is a sectional view showing the cap in FIGS. 9A and 9B with the top lid in a closed state.
Figure 10B:
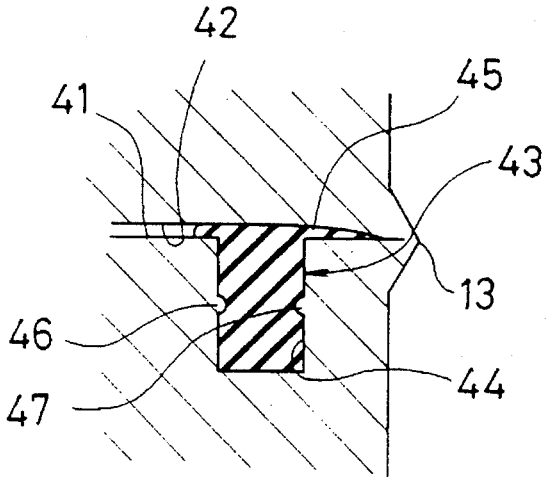
FIG. 10B is an enlarged-scale view showing a portion XB in FIG. 10A.
Figure 11A:
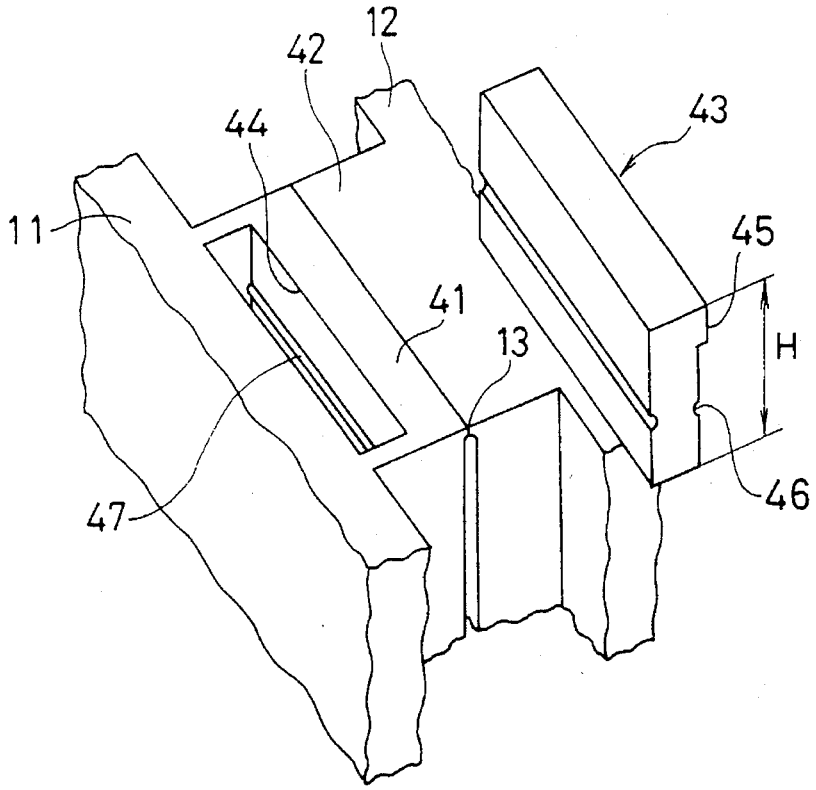
FIG. 11A is a fragmentary perspective view showing the cap in FIGS. 9(A) and 9(B) before the fitting of a rubber-like elastic member.
Figure 11B:
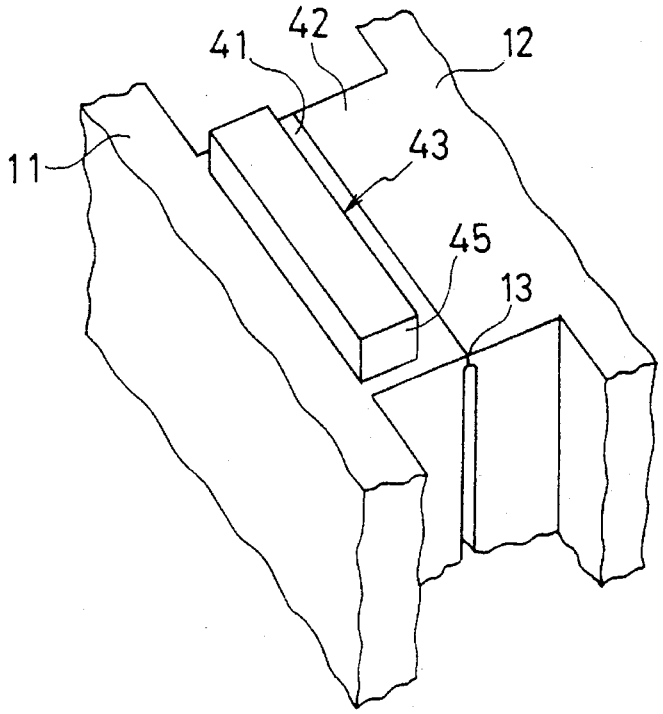
FIG. 11B is a perspective view showing the rubber-like elastic member in FIG. 11A after it has been fitted.

The rubber-like elastic member 43 has a peripheral engagement recess 46, and an engagement protrusion 47 formed on the surface of the groove 44 is engaged in the engagement recess 46. When closing the top lid 12, the flat portion 42 of the top lid 12, causes compressive deformation of the projecting head portion 45 of the rubber-like elastic member 43, as shown in FIGS. 10A and 10B. As in the previous first embodiment, by releasing the lock mechanism 24, the elastic restoring force due to the compressive deformation of the rubber-like elastic member 43 acts on the top lid 12 to cause the top lid 12 to be opened gently at an adequate speed. The elastic restoring force of the rubber-like elastic member 43 can be adjusted to be higher by setting the height H of the rubber-like elastic member 43 to a greater value (FIGS. 11A and 11B).

Figure 12A:
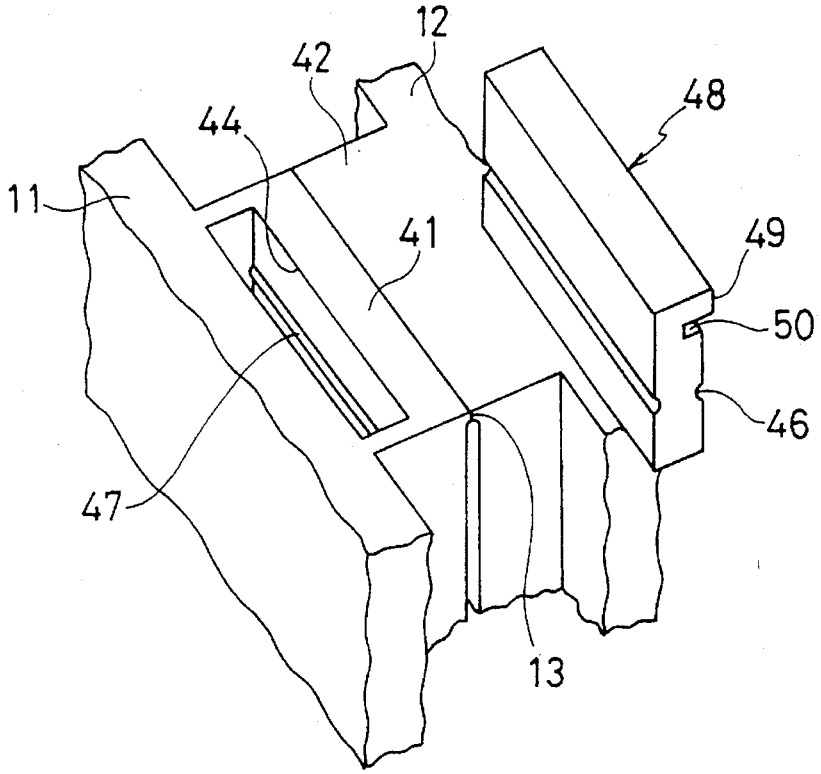
FIGS. 12A and 12B are fragmentary perspective views showing a modification of the rubber-like elastic member in FIG. 11A, FIG. 12A showing the member before the fitting thereof, FIG. 12B showing the member after the fitting thereof.
Figure 12B:
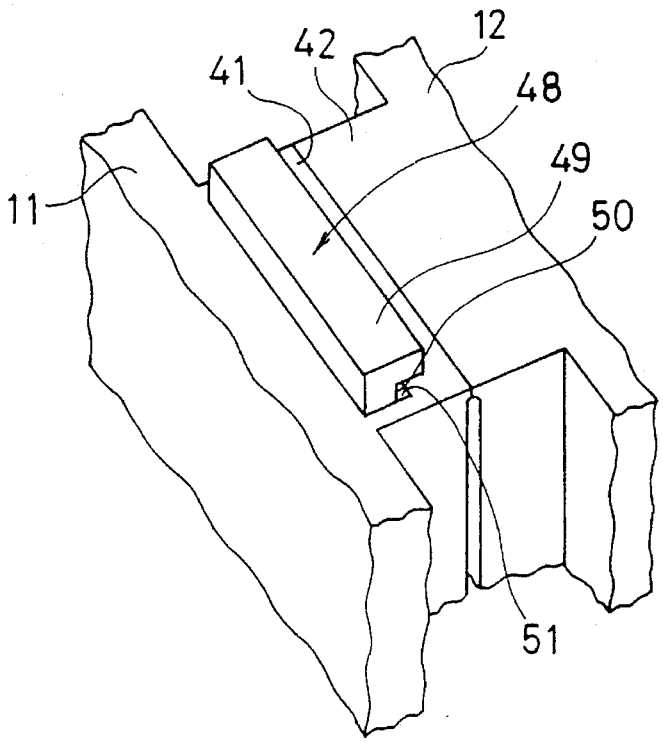

FIGS. 12A and 12B show a rubber-like elastic member 48 which has a head portion 49 formed with a groove 50. When the rubber-like elastic member 48 is fitted in the groove 44 of the cap body 11, the groove 50 forms a clearance 51 with respect to the flat portion 41. Thus, in the rubber-like elastic member 48, when closing the top lid 12, a head portion 49 is compressed, while a portion on the other side of the groove 50 undergoes bending deformation. Thus, the top lid 12 can be opened by these elastic restoring forces.

FOURTH EMBODIMENT

In the fourth embodiment, parts like those in the previous first embodiment are designated by like reference numerals and symbols and are not described again.

Figure 13A:
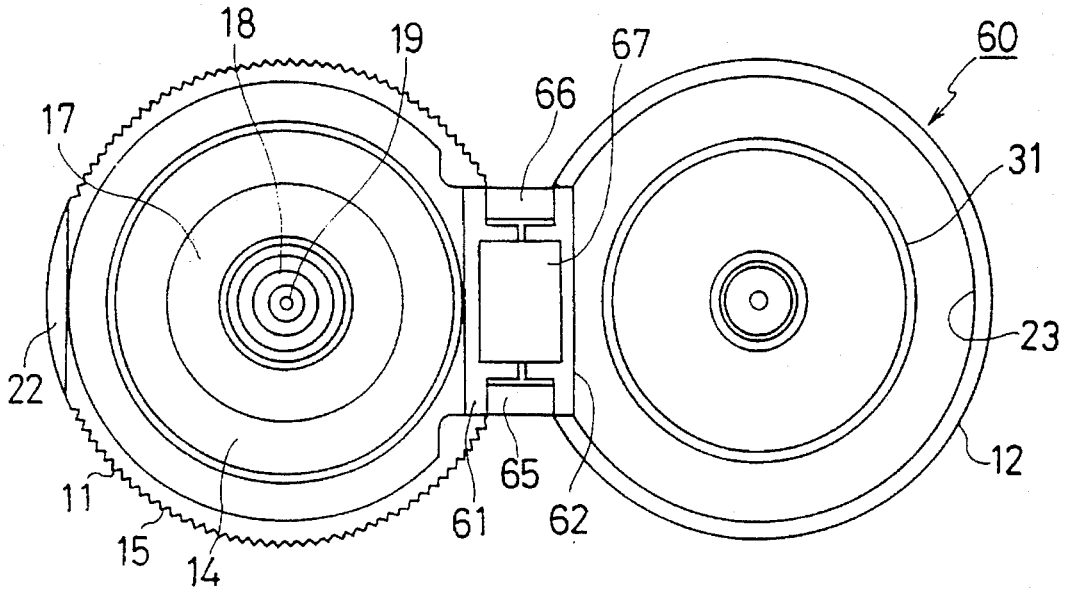
FIGS. 13A and 13B show a fourth embodiment of the cap according to the invention with a top lid in an open state, FIG. 13A being a plan view, FIG. 13B being a side view.
Figure 13B:
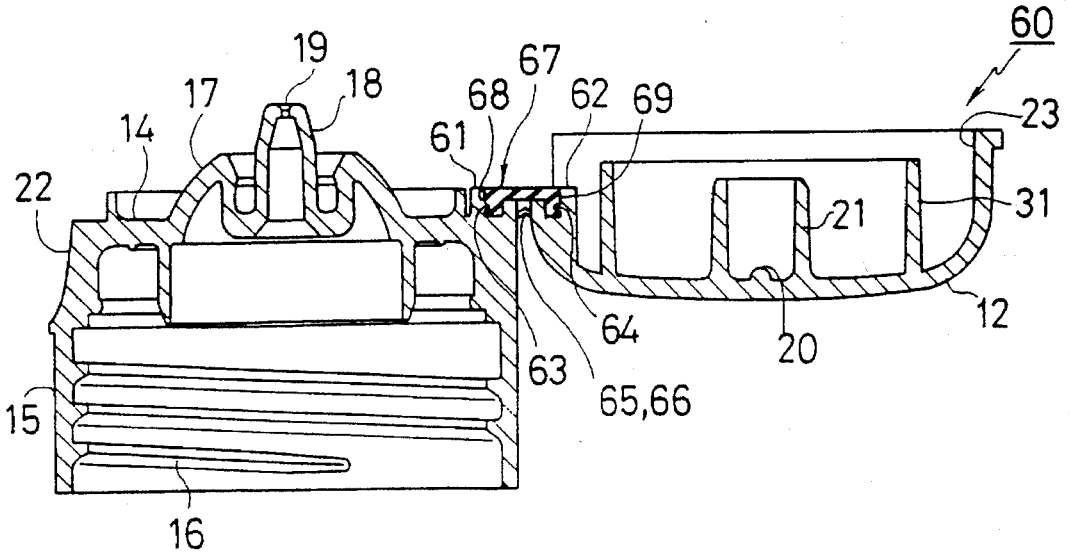
Figure 15:
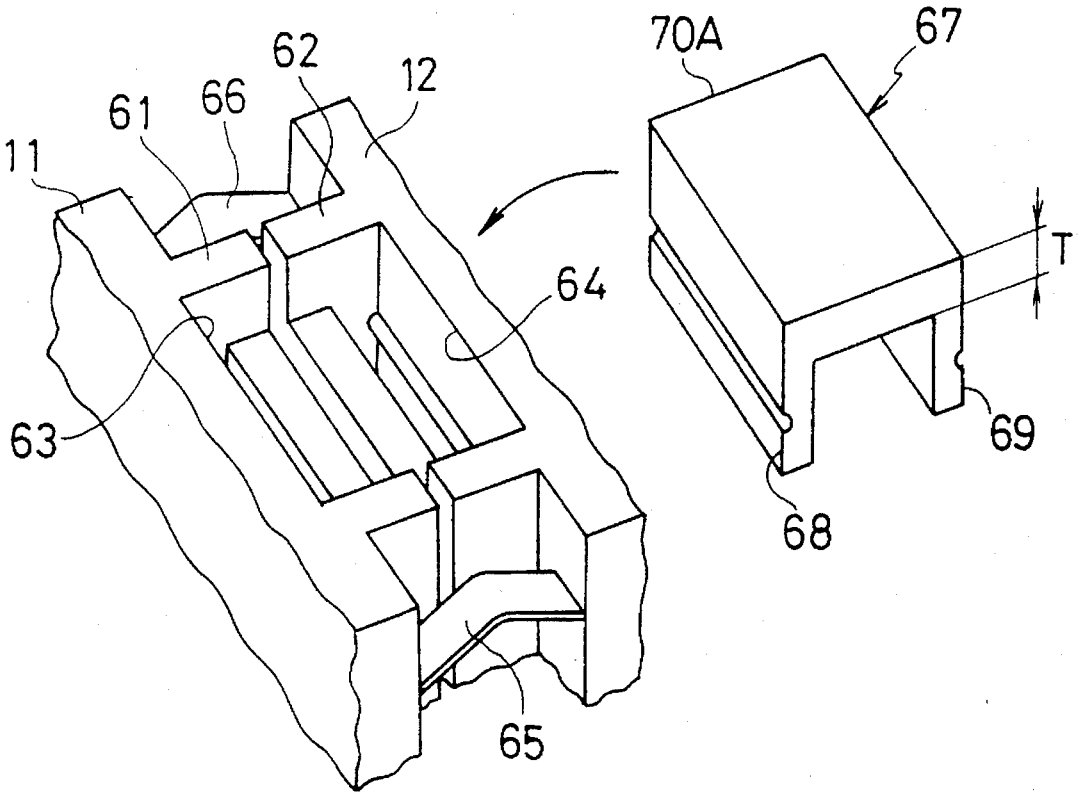
FIG. 15 is a fragmentary perspective view showing a rubber-like elastic member in the cap in FIGS. 13A and 13B together with portions of the cap body and the top lid.

FIGS. 13A and 13B show the fourth embodiment of the cap 60. In this instance, the cap body 11 and the top lid 12 have respective flat portions 61 and 62 formed with grooves 63 and 64. These grooves 63 and 64 have substantially the same shape. Further, as shown in FIGS. 13A, 13B and 15, the main hinge 13 as in the previous first to third embodiments is not provided between the cap body 11 and the top lid 12, but the flat portions 61 and 62 are united at their ends by sub-hinges 65 and 66. By the term "sub-hinge" in this embodiment is meant a hinge, which has a small thickness compared to the main hinge and is capable as a whole of flexing deformation or elongating or contracting deformation as well as being capable of fulcrum position variation.

Further, as shown in FIGS. 13A and 13B, the sub-hinges 65 and 66 can prevent detachment of the top lid 12 when opening the top lid 12. The prevention of detachment of the top lid 12 is also made by a rubber-like elastic member 67 which is provided between the cap body 11 and the top lid 12.

The rubber-like elastic member 67, as shown in FIGS. 13A, 13B and 15, has a substantially channel-shaped sectional profile. It has one end 68 fitted in the groove 63 of the cap body 11 and the other end 69 fitted in the groove 64 of the top lid 12. When closing the top lid 12, a portion 70A of the rubber-like elastic member 67 undergoes bending deformation as shown in FIG. 14B.

Thus, by releasing the lock mechanism 24 when closing the top lid 12, an elastic restoring force due to the bending deformation of the rubber-like elastic member 67 is acted on the top lid 12, thus opening the top lid 12.

By increasing the tension in the rubber-like elastic member 67 applied in the direction of the grooves 63 and 64, it is possible to set a reduced opening angle of the top lid 12 in the open state thereof as provided by the rubber-like elastic member 67. In addition, by increasing the thickness T of the rubber-like elastic member 67, it is possible to set an increased bending restoring force provided by the rubber-like elastic member 67, thus permitting the setting of an increased opening angle of the top lid 12 in the open state thereof. Other effects as those in the above embodiments are also obtainable.

Figure 14A:
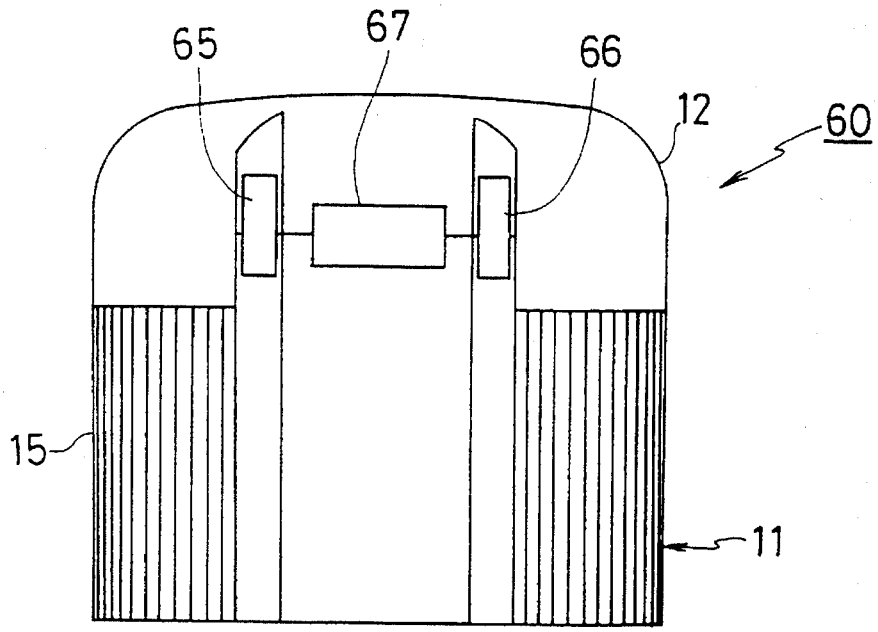
FIGS. 14A and 14B show the cap in FIGS. 13A and 13B with the top lid in a closed state, FIG. 14A being a back view, FIG. 14B being a sectional view.
Figure 14B:
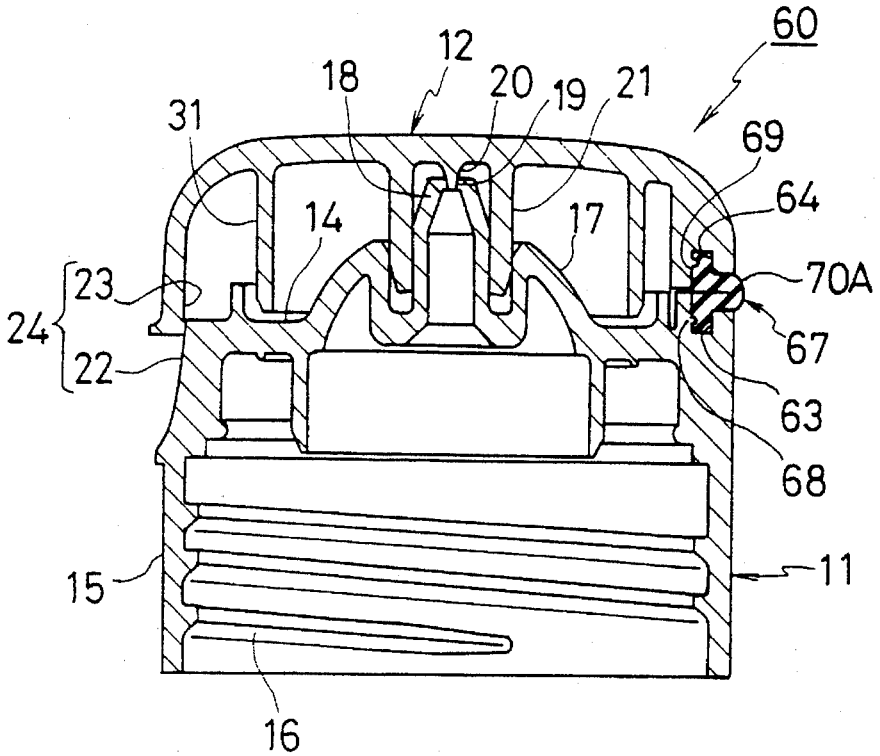
Figure 16A:
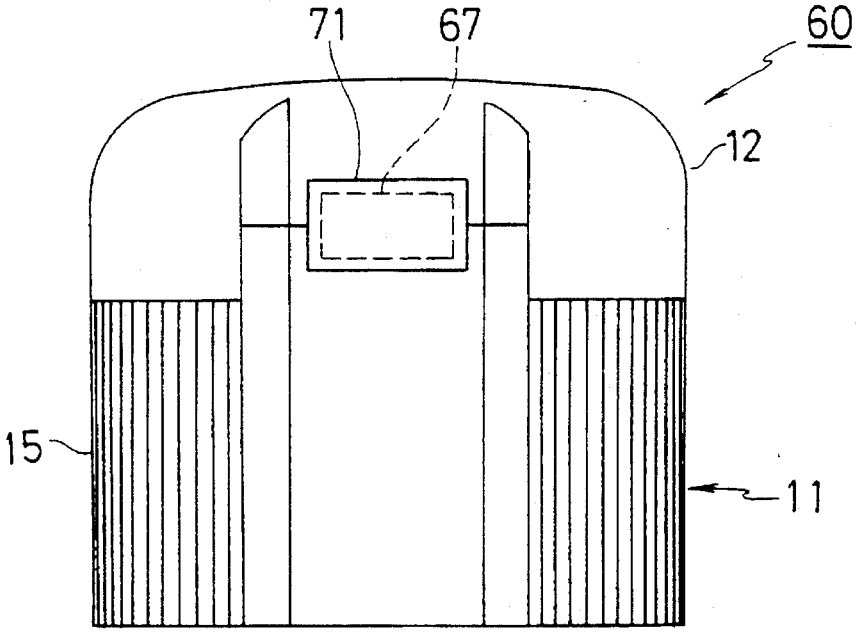
FIGS. 16A and 16B show a modification of the fourth embodiment of the cap, FIG. 16A being a back view, FIG. 16B being side view.
Figure 16B:
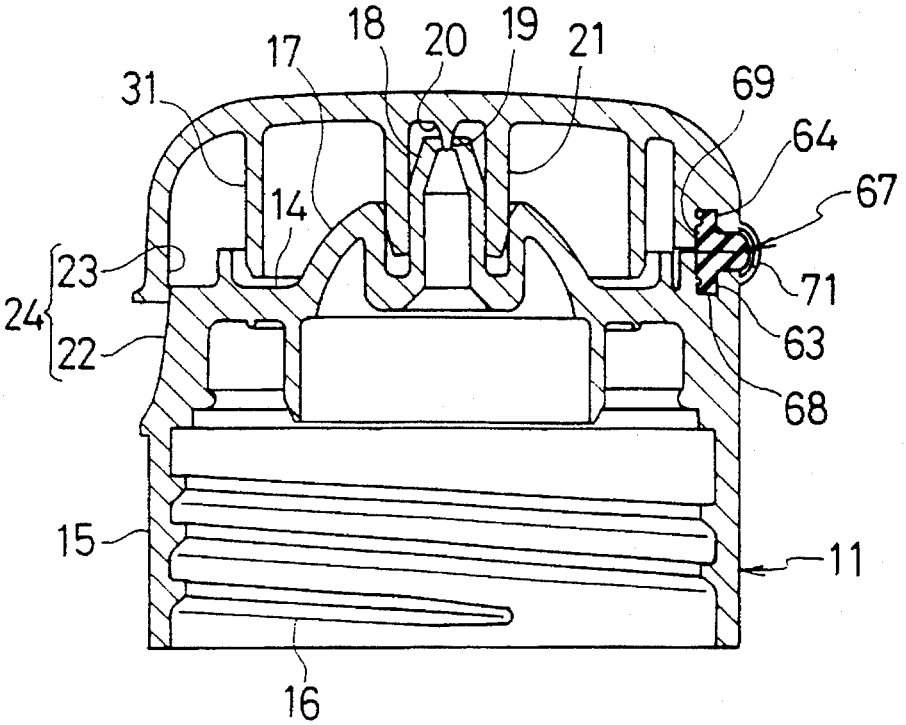

In this fourth embodiment, in the closed state of the top lid 12, the rubber-like elastic member 67 is seen from the outside, as shown in FIGS. 14A and 14B. FIGS. 16A and 16B show a modification of the fourth embodiment. In this instance, a sub-hinge 71 is provided in place of the sub-hinges 65 and 66. The sub-hinge 71 is provided between the cap body 11 and the top lid 12 such as to cover the back of the rubber-like elastic member 67. When the top lid 12 is in the closed state, the rubber-like elastic member 67 is thus concealed, and thus the appearance of the cap 60 is improved.

As a further alternative to the fourth embodiment and the modification thereof, it is possible to provide the main hinge 13 in place of the sub-hinges 65 and 66 or 71 between the cap body 11 and the top lid 12 so that the top lid 12 is opened by the sole elastic restoring force provided by the rubber-like elastic member 67 due to the bending deformation thereof.

FIFTH EMBODIMENT

In the fifth embodiment, pans like those in the preceding fourth embodiment are designated by like reference numerals and symbols and are not described again.

Figure 17A:
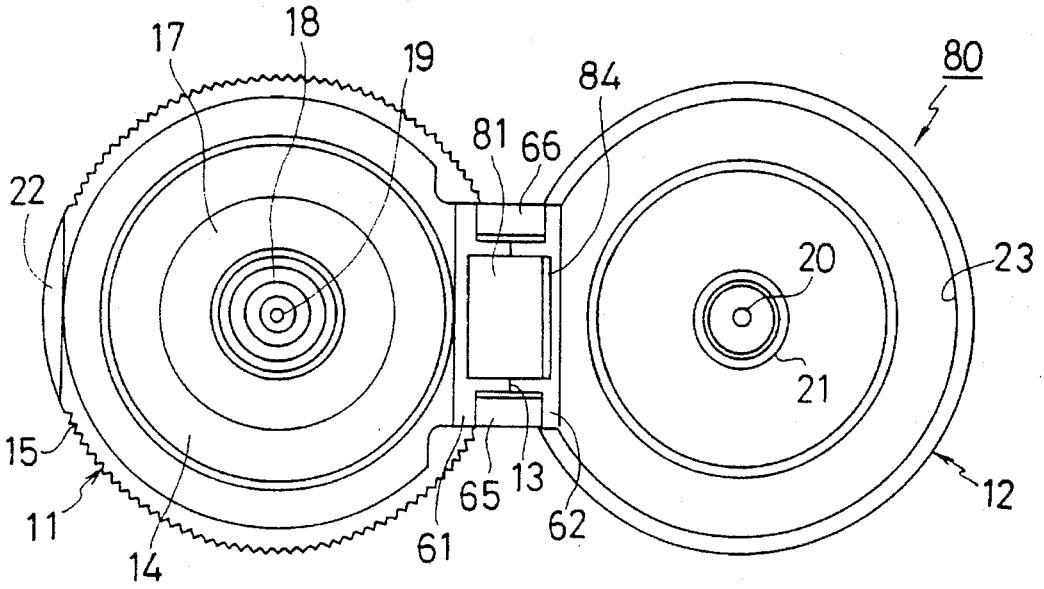
FIGS. 17A and 17B show a fifth embodiment of the cap according to the invention with a top lid in an open state, FIG. 17A being a plan view, FIG. 17B being a side view.
Figure 17B:
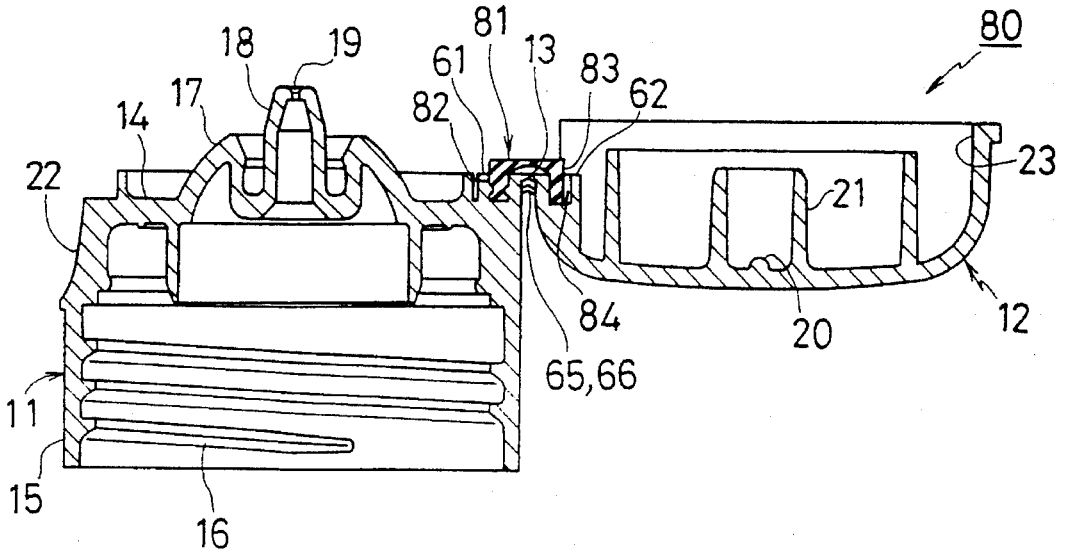
Figure 18:
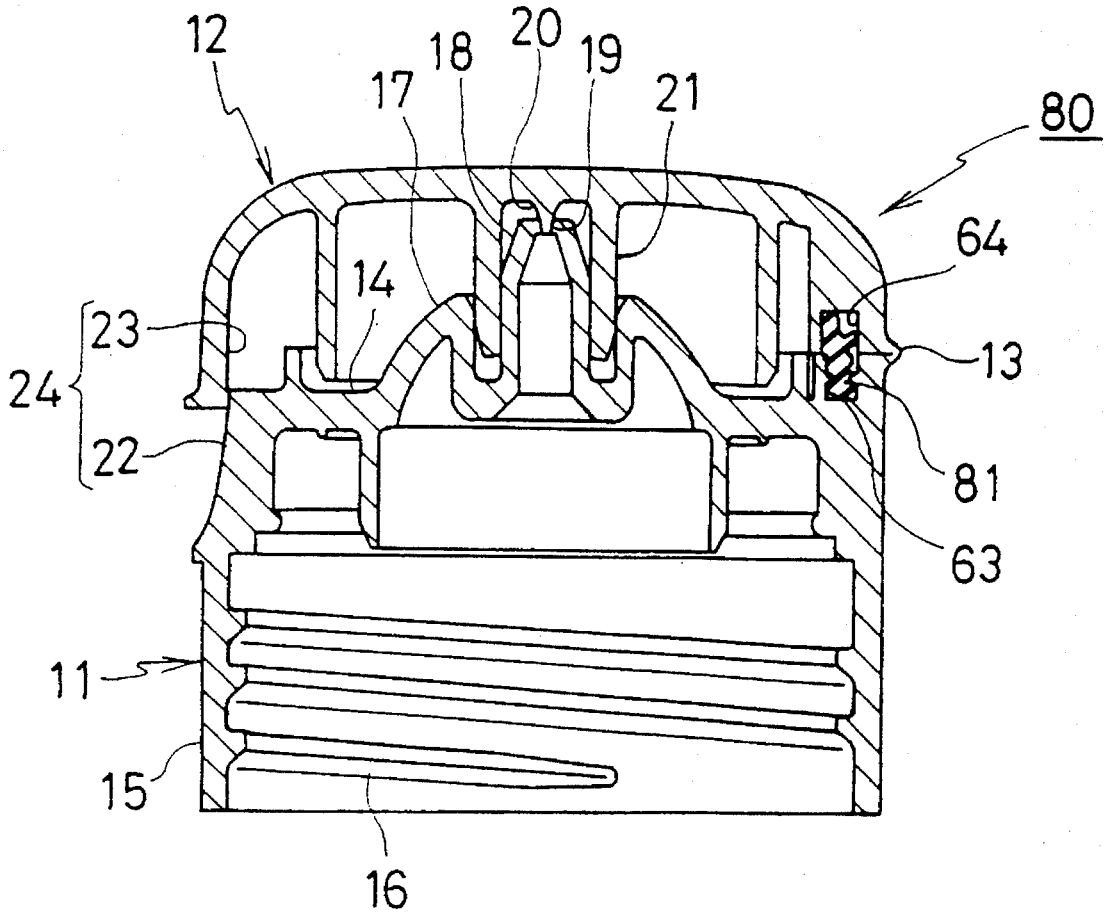
FIG. 18 is a sectional view showing the cap in FIGS. 17A and 17B with the top lid in a closed state.
Figure 19A:
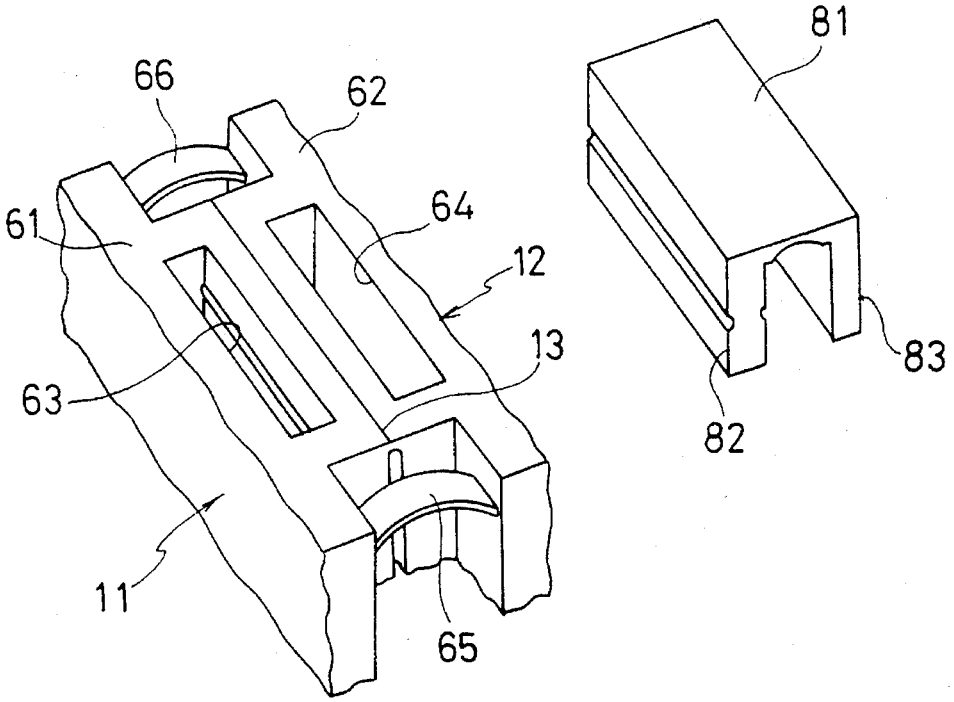
FIG. 19A is a fragmentary perspective view showing a rubber-like elastic member together with the cap body and the top lid in the cap in FIG. 18 before it is fitted.
Figure 19B:
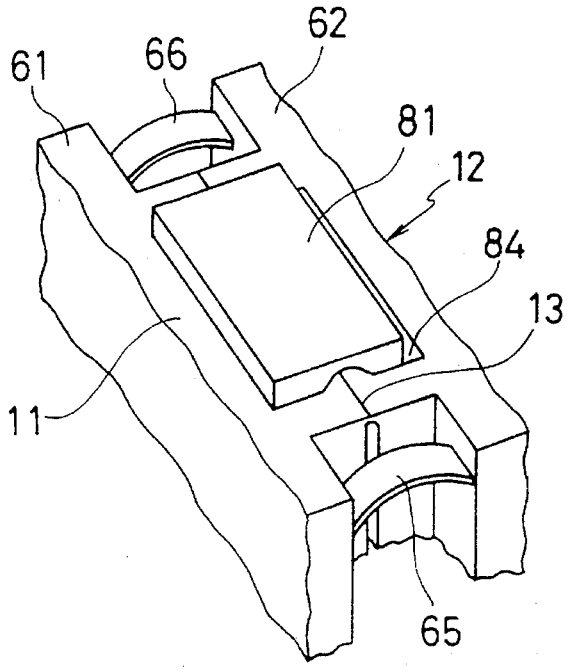
FIG. 19B is a fragmentary perspective view showing the rubber-like elastic member after it is fitted.
Figure 20:
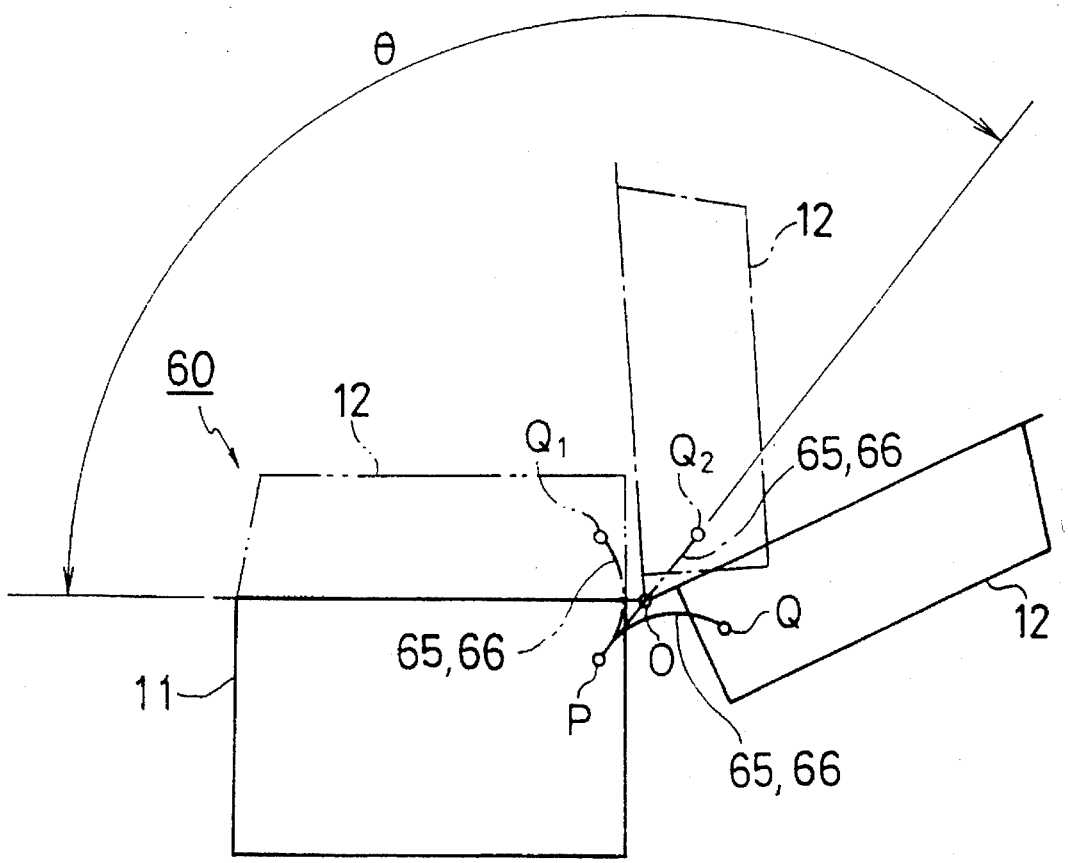
FIG. 20 is a view illustrating the function of the cap in FIGS. 17A and 17B.

FIGS. 17A and 17B show this embodiment of the cap 80. In this instance, the cap body 11 and the top lid 12 are coupled to each other by a main hinge 13 and also by sub-hinges 65 and 66. Referring to FIG. 20, the hinge point between the cap body 11 and the top lid 12 (i.e., the fulcrum point of the main hinge 13) is denoted by O, and the opposite ends of the sub-hinges 65 and 66 are referred to as points P, Q, $Q_1$ and $Q_2$. Further, the angle of the top lid 12 when the points O, P and Q are on a straight line is referred to as threshold angle θ. At the threshold angle θ, the sub-hinges 65 and 66 are in their state of utmost elongation. At an angle less than the threshold angle θ, the sub-hinges 65 and 66 bias the top lid 12 in the closing direction (tending to cause contraction of the elongated sub-hinges 65 and 66), while at the threshold angle or above they bias the top lid 12 in the opening direction. The combination of the main hinge and sub-hinges which performs the above operation is generally referred to as a snap hinge. This cap 80 uses a rubber-like elastic member 81 of a substantially channel-shaped sectional profile, which has one end 82 fitted in a groove 63 formed in the cap body 11 and the other end 83 is fitted in a groove 64 such as to provide a clearance 84. The clearance 84 allows compression of the other end 83 of the rubber-like elastic member 81 in the course of closing of the top lid 12 as shown in FIG. 18. Thus, in the closed state of the top lid 12 the rubber-like elastic member 81 is bending and compressive deformed.

In this embodiment, the elastic restoring force of the rubber-like elastic member 81 due to the bending and compressive deformations thereof thus acts on the top lid 12. The top lid 12 is thus opened against the biasing forces of the sub-hinges 65 and 66 at its angle less than the threshold angle θ, while it is opened by the biasing forces of the sub-hinges 65 and 66 at the threshold angle θ or above. Other effects as those in the other embodiments are also obtainable with this fifth embodiment as well.

SIXTH EMBODIMENT

In the sixth embodiment, parts like those in the first and fifth embodiments are designated by like reference numerals and symbols and are not described again.

Figure 21A:
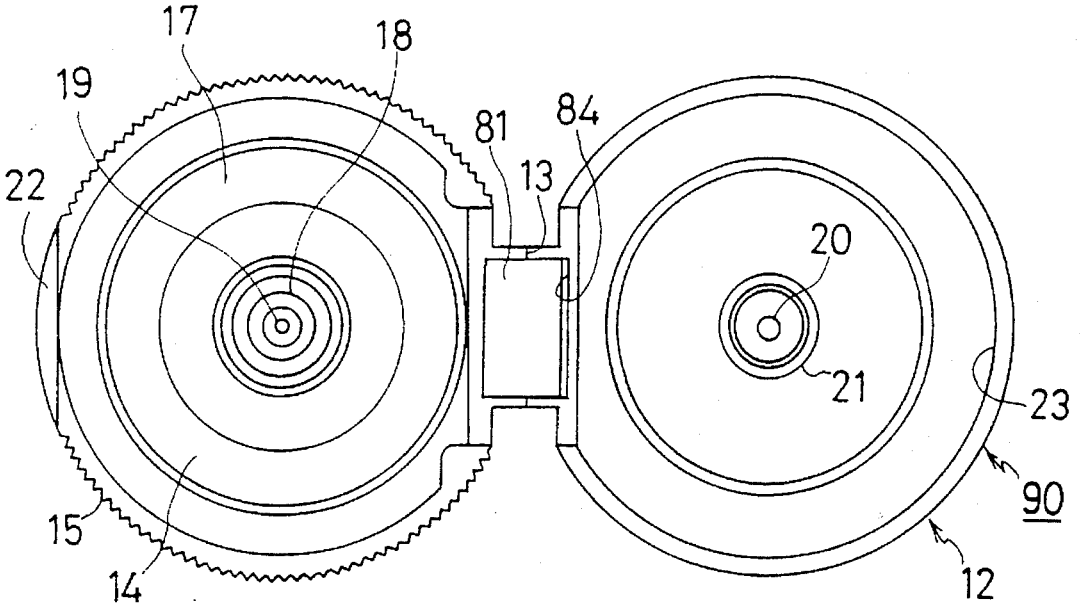
FIGS. 21A and 21B show a sixth embodiment of the cap according to the invention with a top lid in an open state, FIG. 21A being a plan view, FIG. 21B being a sectional view.
Figure 21B:
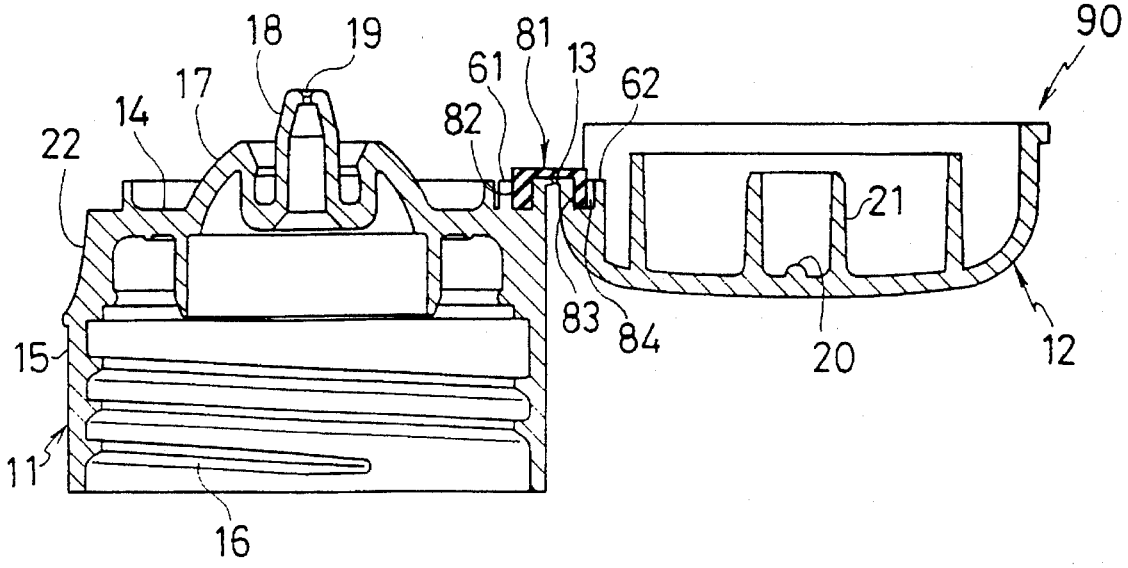
Figure 22:
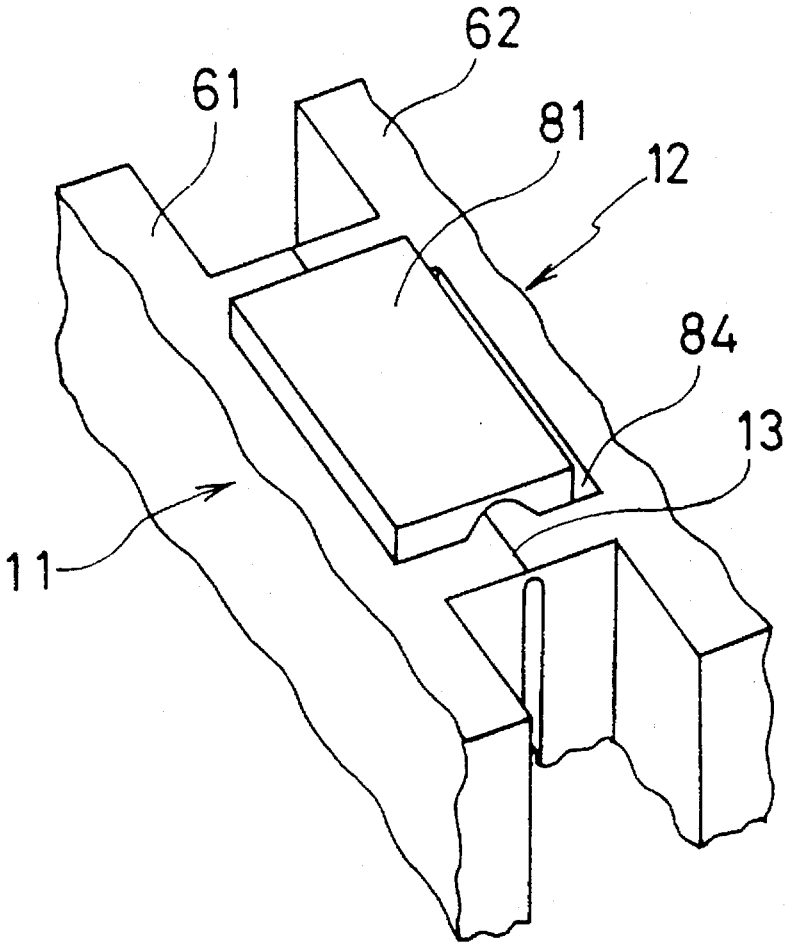
FIG. 22 is a fragmentary perspective view showing a rubber-like elastic member in the cap in FIGS. 21A and 21B together with the cap body and the top lid.

FIGS. 21A and 21B show the sixth embodiment of the cap 90. In this instance, the sub-hinges 65 and 66 are not provided between the cap body 11 and the top lid 12. Instead, the cap body 11 and the top lid 12 are coupled together by the main hinge 13. Thus, while in this cap 90 the rubber-like elastic member 81 undergoes compressive and bending deformations when closing the top lid 12, without the sub-hinges 65 and 66, it is possible to set the elastic restoring force of the rubber-like elastic member 81 due to the compressive and bending deformations thereof to a low value. This is so because with the top lid 12 at an angle less than the threshold angle θ there is no need for the rubber-like elastic member 81 to open the top lid 12 against the biasing forces that may otherwise be provided to the top lid 12 by the sub-hinges 65 and 66 in the closing direction. Other effects like those in the above embodiments are obtainable in this sixth embodiment as well.

SEVENTH EMBODIMENT

Figure 23A:
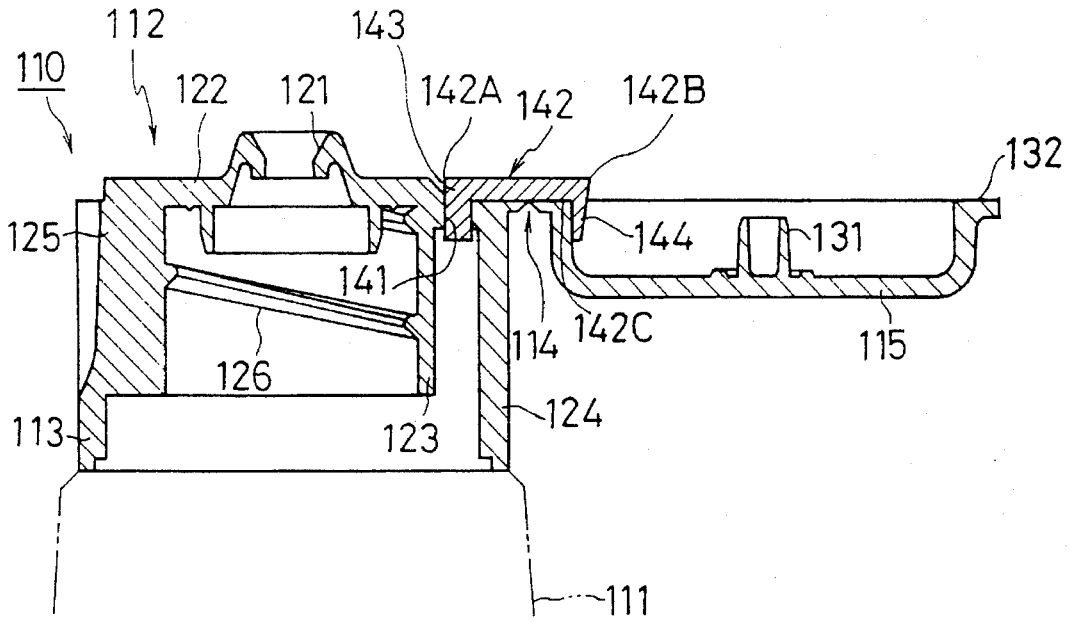
FIGS. 23A and 23B show a seventh embodiment of the cap according to the invention with a top lid in an open state, FIG. 23A being a sectional view, FIG. 23B being a plan view.
Figure 23B:
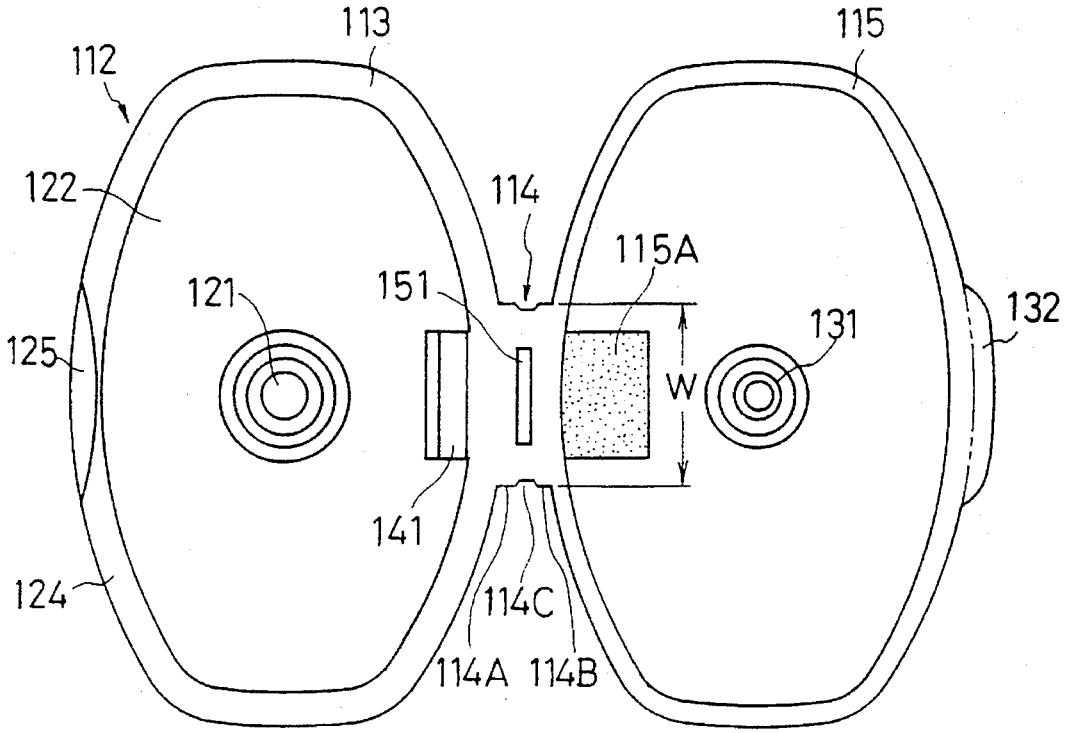

FIGS. 23A and 23B show the seventh embodiment of the cap 112. In this instance, the cap 112 is on a container body 111 of a container 110 adjacent an opening thereof. With the cap 112 in an open state, the container content, such as a cleaning material, can be brought out by squeezing or likewise deforming the container body 111.

The cap 112 comprises a cap body 113 and a top lid 115 hinged thereto via a hinge 114. The cap body 113, the hinge 114 and the top lid 115 are formed as a one-piece molding of polypropyrene or like thermoplastic resin.

The cap body 113 has a top wall 122 with an outlet port 121, a mounting cylinder 123 integral with the top wall 122 and surrounding the outlet port 121, and an outer cylinder 124 integral with the top wall 122 and surrounding the mounting cylinder 123. On the front side of the cap 112, the outer cylinder 124 of the cap body 113 has a depression 125 formed at a position on the side opposite the hinge 114. The mounting cylinder 123 is a circular cylinder and has a female thread 126. The cap 112 can be mounted on the container body 111 by screwing the female thread 126 on a male thread that is formed on the container body 11 adjacent the opening. The outer cylinder 124 is an angular cylinder that fits the outer diameter of the container body 111.

The top lid 115 is cup-shaped, and its inner surface is formed with a central sealing engagement projection 131 which can be in scaling engagement in the outlet port 121 of the cap body 113 to maintain the top lid 115 in the closed state thereof. Also, when the top lid 115 is in the closed state, the two engaged parts provide an engagement force to hold the top lid closed. The top lid 115 has a top lid opener 132, which is found on the front side of the cap 112 and above the depression 125 provided in the cap body 113 and can provide a top lid opening force.

Figure 24A:
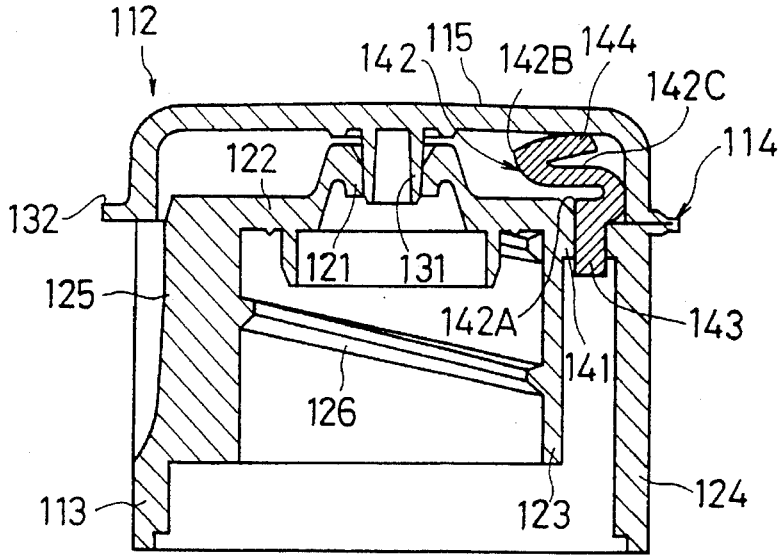
FIGS. 24A and 24B show the seventh embodiment of the cap with the top lid in a closed state, FIG. 24A being a sectional view, FIG. 24B being a plan view.

The top wall 122 of the cap body 113 has a groove 141 formed near the hinge 114. A rubber-like elastic member 142 is fitted in the groove 141. The rubber-like elastic member 142 is made of rubber or elastomer (i.e., methylvinyl type raw rubber synthesized from, for instance, "KE951U" (a trade name" by Shinetsu Kagaku Kogyo Co., Ltd.) as a compound and "C-8" (a trade name by the same company) as a vulcanizer). The rubber-like elastic member 142 is substantially channel-shaped in the sectional profile as shown in FIG. 24A, and it has one end 143 fitted in the groove 141. The other end 144 of the rubber-like elastic member 142 has a wedge-like tapered shape with its tip in contact with the inner surface of the top lid 115 and capable of compressive and bending deformations.

That is, during the course of closing the top lid 115, the top of the other end 144 of the rubber-like elastic member 142 is brought into contact with and pushed by the inner surface of the top lid 115. As it is pushed, the other end 144 of the rubber-like elastic member 142 is bent inward, and portions 142A and 142B of the rubber-like elastic member 142 undergo bending deformation. When the top lid 115 is closed, the other end 144 undergo compressive deformation such that it is folded between the inner surface 142C of the rubber-like elastic member 142 and the top lid 115.

Figure 25:
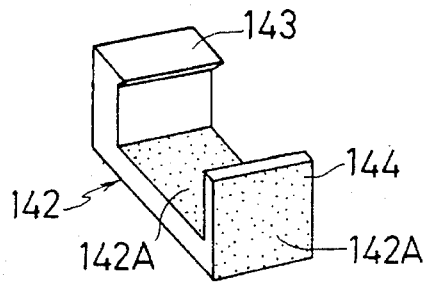
FIG. 25 is a rubber-like elastic member in the cap in FIGS. 24A and 24B.

In the cap 112, both (or either one) of the surfaces of the top lid 115 and the rubber-like elastic member 142 that are separated from each other when the top lid 115 is opened and are brought into contact with each other when the top lid is closed, are made to be non-flat surfaces 115A and 142A (FIGS. 23B and 25). The non-flat surfaces 115A and 142A are formed by embossing. Alternatively, they are provided with a plurality of small protuberances.

In the cap 112, the hinge 114 has a large thickness portion 114A terminating in the cap body 113, a large thickness portion 114B terminating in the top lid 115 and a small thickness portion 151 between the two large thickness portions 114A and 114B. The small thickness portion 114C has a removed portion 151. The removed portion 151 is formed centrally of the width W of the hinge 114.

The cap 112 is operable as follows.

(1) When closing the top lid 115 of the cap 112, the sealing engagement projection 131 of the top lid 115 is engaged in the outlet port 121 of the cap body 113 to generate a top lid engagement force so as to maintain the top lid 115 in the closed state. In this state, the rubber-like elastic member 142 is given bending and compressive deformations between the cap body 113 and the top lid 115.

(2) To open the top lid of the cap 112, by holding the container body 111 gripped with a hand, the top lid opener 132 of the top lid 115 is pushed up by exerting a top lid opening force with a thumb, for instance. As a result, the top lid 115 is pushed up about the hinge 114 in the direction of opening the lid, whereby the sealing engagement projection 131 of the top lid 115 is detached from the outlet port 121 of the cap body 113. Simultaneously with the release of engagement between the sealing engagement projection 131 and the outlet port 121, the elastic restoring force of the rubber-like elastic member 142 having been elastically deformed acts as a force to open the top lid 115 and thus opens the top lid 115 as in (1) above.

Now, the functions of the embodiment will be described.

(1) Since the rubber-like elastic member 142 provided between the cap body 113 and the top lid 115 is adapted to be elastically deformed when closing the top lid 115, with the release of the closed state of the cap body 113 and the top lid 115, the elastic restoring force of the rubber-like elastic member 142 having been elastically deformed has an effect of opening the top lid 115. This restoring force is not excessive unlike that of a coil spring, and it permits the top lid 115 to be opened gently at an adequate speed.

Further, what provides the restoring force to the top lid 115 is the rubber-like elastic member 142 and not a coil spring or the like made of a metal. Thus, it is not rusted, and there is no possibility of intrusion of rust into the content that is brought out through the outlet port 121 of the cap body 113.

Further, since the end 143 of the rubber-like elastic member 142 is fitted in the groove 141 of the cap body 113 without use of any adhesive, there is no possibility of flow-out of adhesive into the content in the container, nor any phenomenon of deterioration of adhesive that might otherwise be caused by the container content.

(2) Since the hinge 114 is provided with a removed portion 151, it is possible to set the bending rigidity of the hinge 114 to a small value to permit ready movement of the hinge 114 without need of excessively increasing the thickness or width of the hinge 114. Thus, without need of increasing the elastic restoring force of the rubber-like elastic member 142, it is possible to provide a sufficient opening force to the hinge 114 and ensure a sufficient opening angle of the top lid even at a low temperature, at which the bending rigidity of the hinge 114 is increased.

That is, the rubber-like elastic member 142 need not reliably provide a high elastic restoring force, and thus it may have a small thickness. That is, the top lid locking force to be generated by the top lid locking means between the cap body 113 and the top lid 115 (i.e., the outlet port 121 and the sealing engagement projection 131), that is, the sum of the elastic restoring force provided by the rubber-like elastic member 142 and the sealing force provided to the outlet port 121 of the cap body 113, may be of a small value, and thus it is possible to set the top lid operation force corresponding to the top lid locking force provided when the top lid is opened to a small value to improve the top lid operation control character.

Further, since the width of the hinge 114 is not particularly reduced while setting a small value of the bending rigidity of the hinge 114, the top lid 115 can be stably positioned relative to the cap body 113 even with a deviation of the operation of closing the top lid 115 during this operation. That is, the torsional deformation angle of the hinge 114 is small, and there is no possibility of torsional breakage of the hinge 114.

Figure 24B:
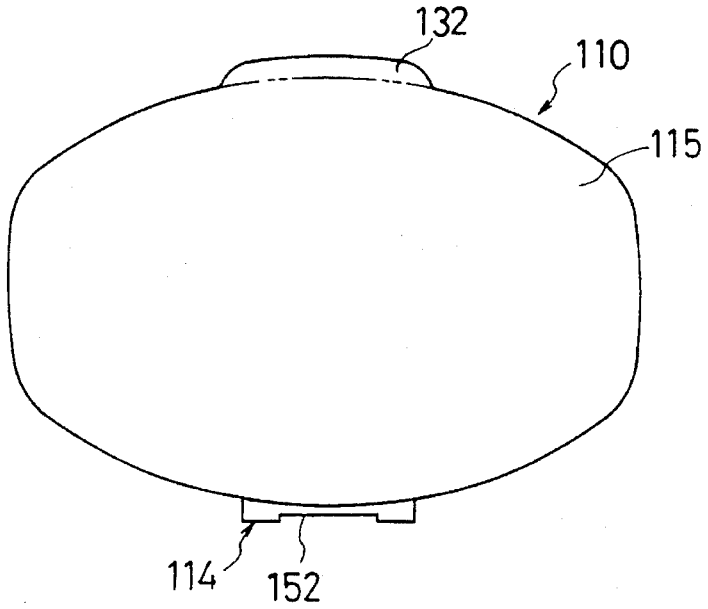

(3) Where the hinge 114 comprises the large thickness portion 114A terminating in the cap body 113, the large thickness portion 114B terminating in the top lid 115 and the small thickness portion 114C between the two large thickness portions 114A and 114B, with the provision of the removed portion 151 in the small thickness portion, the notch 152 (FIG. 24B) formed in the back of the hinge 114 may be shallow when closing the top lid, and there is no possibility for the corners of the notch 152 to be caught by fingers or the like. There is thus no possibility of spoiling the character of handling of the container 110.

(4) Since the surfaces of the top lid 115 and the rubber-like elastic member 142 that are brought into contact with each other when closing the top lid are made non-flat surfaces 115A and 142A, even with breeding-out of lubricant, anti-charging agent and other additives contained in the resin of the top lid 115 as a result of leaving the top lid 115 in the closed state for a long time (particularly at a high temperature), there is no possibility of blocking of the contact surfaces of the top lid 115 and the rubber-like elastic member 142. The top lid 115 thus can be opened to a great extent by the elastic restoring force of the rubber-like elastic member 142 even after it has been left closed for a long time.

Table 1 below shows the result of examination of the opening angle of the top lid in the cap according to the invention. The cap was made of polypropyrene, and the rubber-like elastic member was made of silicone rubber. Cap 1 was fabricated without providing of non-flat surfaces as noted above. Cap 2, on the other hand, was provided with non-flat surfaces on the cap side. The opening angle was examined after leaving the caps at 5° C., room temperature and 40° C. for six months. It is recognized that with the cap 1 the top lid opening angle is small due to blocking caused as a result of leaving the top lid closed for long time, whereas with the cap 2 the top lid opening angle is large owing to the prevention of the blocking. The variation of the opening angle at the individual temperatures is due to permanent compressive strain in silicone rubber. A temperature of 40° C. is a considerably stringent condition, but even at this temperature it was possible with the cap 2 to obtain an opening angle of 90 degrees which is permissible in use.

TABLE 1

| | Top lid opening angle | |
|---|---|---|
| Leaving temperature | Cap 1 | Cap 2 |
| 5° C. | 86 degrees | 120 degrees |
| Room temperature | 69 degrees | 115 degrees |
| 40° C. | 50 degrees | 90 degrees |

In carrying out the invention, the non-flat surfaces (115A, 142A) may be provided on either or both of the cap body and/or top lid and the rubber-like elastic member. The non-flat surfaces of the cap body and/or top lid and the rubber-like elastic member may be formed only in portions to be brought into contact with each other or a portion or entirety including portions to be brought into contact with each other.

As has been shown in the foregoing, according to the invention, there is no possibility of intrusion of rust into the container content, and the top lid can be opened gently and at an adequate speed by the restoring force of the rubber-like elastic member.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above but to include all possible embodiments which can be embodied within a scope encompassed and equivalents thereof with respect to the feature set out in the appended claims.

What is claimed as new and desired to be secured by Letters Patent of the United States is:

1. A cap comprising:

a cap body having a top lid hinged thereto by a hinge, said top lid being closed by a lock mechanism, said lock mechanism being formed on the cap body and on the top lid; and an elastic rubber member having a first end and a second end, said first end of said elastic rubber member being secured near said hinge of said top lid;

wherein said second end of said elastic rubber member is capable of compressive and elastic bending deformations when pushed by a restraining wall of said cap body between said cap body and said top lid when said top lid is closed, so as to produce an elastic restoring force in said elastic rubber member when said top lid is closed, said elastic restoring force of said elastic rubber member causing the top lid to open to a fully opened position when the lock mechanism is released, and permitting the elastic rubber member to maintain contact with both the cap body and the top lid during the opening of the top lid to maintain the top lid in said fully opened position, two clamp portions are provided at the first end of said elastic rubber member, said two clamp portions clamping a support of the top lid to secure said rubber elastic member to said top lid.

2. The cap according to claim 1, wherein at least one of surfaces of said cap body and said elastic rubber member are spaced apart when said top lid is opened and are in contact with each other when said top lid is closed is a non-flat surface.

3. A cap comprising:

a cap body having a top lid hinged thereto by a hinge, said top lid being closed by a lock mechanism, said lock mechanism being formed on the cap body and on the top lid; and an elastic rubber member having a first end and a second end, said first end of said elastic rubber member being secured near said hinge of said top lid;

wherein said second end of said elastic rubber member is capable of compressive and elastic bending deformations when pushed by a restraining wall of said cap body between said cap body and said top lid when said top lid is closed; and two clamp portions are provided at the first end of said elastic rubber member, said two clamp portions clamping a support of the top lid to secure said elastic rubber member to said top lid.

* * * * *